US006419375B1

(12) United States Patent
Leadford et al.

(10) Patent No.: US 6,419,375 B1
(45) **Date of Patent: *Jul. 16, 2002**

(54) LIGHTING FIXTURES HAVING IMPROVED LIGHT DISTRIBUTION

(75) Inventors: Kevin F. Leadford, Evergreen, CO (US); Jeffrey M. Quinlan, Covington, GA (US)

(73) Assignee: Acuity Brands, Inc., Atlanta, GA (US)

( * ) Notice: Subject to any disclaimer, the term of this patent is extended or adjusted under 35 U.S.C. 154(b) by 3 days.

This patent is subject to a terminal disclaimer.

(21) Appl. No.: 09/659,884

(22) Filed: Sep. 12, 2000

Related U.S. Application Data

(63) Continuation-in-part of application No. 08/838,402, filed on Apr. 7, 1997, now Pat. No. 6,190,023.

(51) Int. Cl.[7] ..... F21V 7/00
(52) U.S. Cl. ..... 362/297; 362/303; 362/263
(58) Field of Search ..... 362/297, 263, 362/304, 305, 346, 347, 348, 303, 539

(56) References Cited

U.S. PATENT DOCUMENTS 6,190,023 B1 * 2/2001 Leadford et al. ..... 362/303

* cited by examiner

*Primary Examiner*—Sandra O'Shea
*Assistant Examiner*—Bao Truong
(74) *Attorney, Agent, or Firm*—Kenneth E. Darnell

(57) ABSTRACT

Luminaires intended to deliver maximal light flux with improved uniformity, the invention provides in certain embodiments a shielding device or flux manager which produces target extinctions by management of flux to precisely pass flux nearby original arc and through a second bounce off the reflector structure to direct that flux back into the beam. A virtual arc is thus produced in proximity to the original arc with the virtual arc acting as a second source. The flux manager acts to reduce glare and "spill" light. Performance optimization is further provided in embodiments using the flux manager through additional use of a multi-faceted reflector insert which re-aims light which would have been incident on portions of the reflector structure and which light is blocked by the flux manager. The improved light distribution of the several embodiments of the invention allow use of the flux management concept in lighting fixtures of varying type.

24 Claims, 25 Drawing Sheets

48
50
52
54

8.93
8.280
8.072
7.757
7.301
6.664
5.778
4.527
2.708
0.590
136
11.371
9.416
7.785
6.401
5.185
4.085
3.062
2.093
1.116
104
106
108
110
112
114
116
118
120
122
124
126
128
130
132
134
12°
18°
24°
30°
36°
42°
48°
54°

LIGHTING FIXTURES HAVING IMPROVED LIGHT DISTRIBUTION

CROSS-REFERENCE TO RELATED APPLICATION

This application for patent is a continuation-in-part of U.S. patent application Ser. No. 08/838,402, filed Apr. 7, 1997 now U.S. Pat. No. 6,190,023, by the same inventors and assigned to the same assignee.

BACKGROUND OF THE INVENTION

1. Field of the Invention

The invention relates generally to lighting fixtures configured with flux management structure for preventing light spillage, light potentially wasted as glare being redirected into a beam and onto an area to be illuminated.

2. Description of the Prior Art

Light spillage is an age-old problem encountered in the lighting field, such spillage normally producing undesirable glare. One lighting area in which such spillage is particularly onerous is the field of sports lighting. Sports lighting has evolved over time into a form of outdoor lighting having characteristics similar to outdoor area lighting yet peculiar to those requirements which come into play when lighting athletic playing fields. Uniformity of illuminance is of critical importance as is illumination level per se with these factors being joined by the ever present need for optimum performance at the lowest possible cost. Advances in the art thus occur at least in part through development of luminaire configurations which effectively deliver a maximal amount of flux onto a playing area. In the sports light field in particular both vertical and horizontal illuminances must also be addressed as must illumination levels required for optimum video camera operation inter alia. Luminaire design also typically takes into account conventional arrangements of pole locations, mounting heights and aiming angles. Other objectives include consistent overlap of beam patterns in order to maximize system performance while minimizing costly applications engineering efforts usually associated with sports lighting systems. The prior art has long encompassed the mounting of discrete clusters of sportslighting luminaires at periodic locations about the perimeter of a playing area. Within these conventional system constraints, luminaire performance is evaluated not only as a single unit but also within these discrete clusters, the net distribution of each cluster being necessarily considered in performance evaluation. As is therefore to be appreciated, luminaire design in the sportslighting field is a complex matter dependent upon a variety of factors not the least of which is total system cost.

When considering cost, operational costs cannot be dismissed as inconsequential. Prior sportslighting systems which utilize less efficient light sources such as incandescent and mercury vapor must be improved in order to gain the benefits of greater efficiency with comparable light levels and desirable light quality which are to be gained from sources such as high pressure sodium and metal halide, as examples. Greatest luminaire flexibility is attained through luminaire design capable of using the widest variety of illumination sources to include high pressure sodium and metal halide and the like.

Examples of prior art lighting designed for the purposes to which the present invention are directed are disclosed by Lemons et al in U.S. Pat. Nos. 4,864,476 and 5,313,379 and by Tickner in U.S. Pat. Nos. 5,355,290 and 5,377,086. As is conventional in the art, these patents disclose the use of reflector structures intended to provide desired illumination levels on a work plane. Sportslighting luminaires of the prior art can also be seen in the TV Sportslighting luminaire manufactured by Lithonia Lighting, a division of National Service Industries, Inc. of Atlanta, Ga., this luminaire including in its optical structure an anodized aluminum reflector capable of a range of beam spreads. The TV luminaire further includes a horizontal degree aiming scale and repositioning locator as well as a vertical aiming adjustment mechanism complete with degree aiming scale and a repositioning stop. While sportslighting luminaire devices such as the TV luminaire of Lithonia Lighting provide lighting capabilities of substantial utility and while other luminaire devices of the prior art also provide capabilities desirably useful in the sportslighting field, a need exists in the art for sportslighting luminaires capable of improved cost and energy efficiencies and which particularly provide performance capabilities allowing use of fewer luminaires within a given system arrangement.

Outdoor lighting of other description inherently exhibits many of the same problems described above relative to sportslighting, light spillage becoming glare which can be objectionable for a number of reasons not the least of which is that light wasted as glare is not brought to bear upon an area which is to be illuminated. Floodlighting applications also are illuminated by fixtures which suffer from light wasted due to spillage and glare and which can be improved as can lighting of many varying forms by the provision of a flux managing feature within the fixture which precisely pass flux nearby original arc and through a second bounce off a reflector structure to direct that flux back into beam A flux managing feature in such lighting fixtures will act to reduce glare and "spill" light and thus optimize performance.

SUMMARY OF THE INVENTION

The invention provides in certain embodiments luminaire structures intended for illumination of stadia, playing fields and similar areas and which are particularly adapted to mounting in discrete clusters on poles or the like at locations about the perimeter of a playing area which is to be illuminated. The luminaire structures of the invention are particularly improved in the several embodiments of the invention by reflectors which usually include a faceted reflector body with individual facets being arranged in a manner intended to optimize performance. In the several embodiments of the invention, improved principal reflectors are used in combination with an illumination source to provide an improved luminaire useful in sportslighting applications. In certain embodiments of the invention, faceted reflectors are combined according to the invention with a shielding device or flux manager and a reflector insert for optimization of light uniformity and reduction of glare and "spill" light. The flux manager structures of the invention produce target extinctions by management of the flux to precisely pass flux nearby original arc and through a second bounce off of the principal reflector to direct that flux back into the beam. A virtual arc is produced in proximity to the original arc with the virtual arc acting as a second source. The reflector insert is a multi-faceted reflector with aimed facets which re-direct light which would have been incident on the flux manager. One embodiment of the invention is comprised of a principal reflector having individual facets aimed in a manner to optimize uniformity of light distribution with reduced glare and light "spill" without the need for a flux manager and reflector insert. The several embodiments of the invention provide improved light distributions and performance of a magnitude which allows use of fewer luminaires for a given playing field configuration.

The luminaire structures of the invention typically include a ballast and junction box housing assembly having mounting trunnion arrangements with a horizontal degree aiming scale and a repositioning locator. Vertical aiming adjustment is also provided to include a degree aiming scale and a repositioning stop. Mounted to the housing assembly is one of the primary reflectors of the invention, the reflectors being sealed by a hinged lens formed of heavy-duty thermal-resistant, shock-resistant and impact-resistant tempered glass. An illumination source such as a standard BT-56 jacketed lamp is mounted within the principal reflector by a porcelain mogul-base socket in a fixed relation to the reflective surfaces of the principal reflector. The luminaire structures of the invention typically utilize high pressure sodium or metal halide lamps of wattages within the range of 400 watts to 1500 watts. A range of beam spreads are provided by the luminaire structures of the invention.

In certain other embodiments of the invention including embodiments which particularly relate to outdoor lighting, spot lighting and other types of lighting, it is to be seen that the use of a flux management feature can produce essentially the same advantages as referred to hereinabove relative to sportslighting per se. In all of these lighting applications, a flux management feature redirects light which would be wasted as "spill" or glare back into an illumination beam which is being directed upon an area to be illuminated. Reflector structures which can be used in these lighting applications can be faceted or can be conventional and may or may not include a reflector insert having the capability of the insert referred to hereinabove as used in sportslighting applications.

Accordingly, it is an object of the invention to provide luminaire structures capable of efficiently illuminating stadia, playing fields and similar areas with light of improved uniformity.

It is another object of the invention to provide luminaire structures intended for sportslighting applications and having improved principal reflectors formed with facets intended to optimize performance, the principal reflectors being useful with conventional illumination sources and being improved in certain embodiments to reduce light "spillage" by the addition of a flux manager intended to produce desired target extinctions, the flux manager creating precise redirection of flux around original arc with the redirected flux being reflected by the principal reflector into the beam, the principal reflectors used with a flux manager further being optimized by addition of a reflector insert having aimed facets which re-direct light blocked by the flux manager.

It is a further object of the invention to provide luminaire structures having improved principal reflectors and/or improved reflector assemblies capable of sufficient improvement of illumination on the work plane of a playing field to allow use of fewer luminaires for a given playing field configuration.

It is a still further object of the invention to provide luminaire structures improved to reduce light "spillage" by the addition of a flux management feature intended to produce desired target extinctions, the flux management feature creating precise redirection of flux around original arc with the redirected flux being reflected by a conventional reflector into a beam for illumination of a given area.

Other objects and advantages of the invention will become more readily apparent in light of the following detailed description of the preferred embodiments.

DESCRIPTION OF THE PREFERRED EMBODIMENTS

Figure 1:
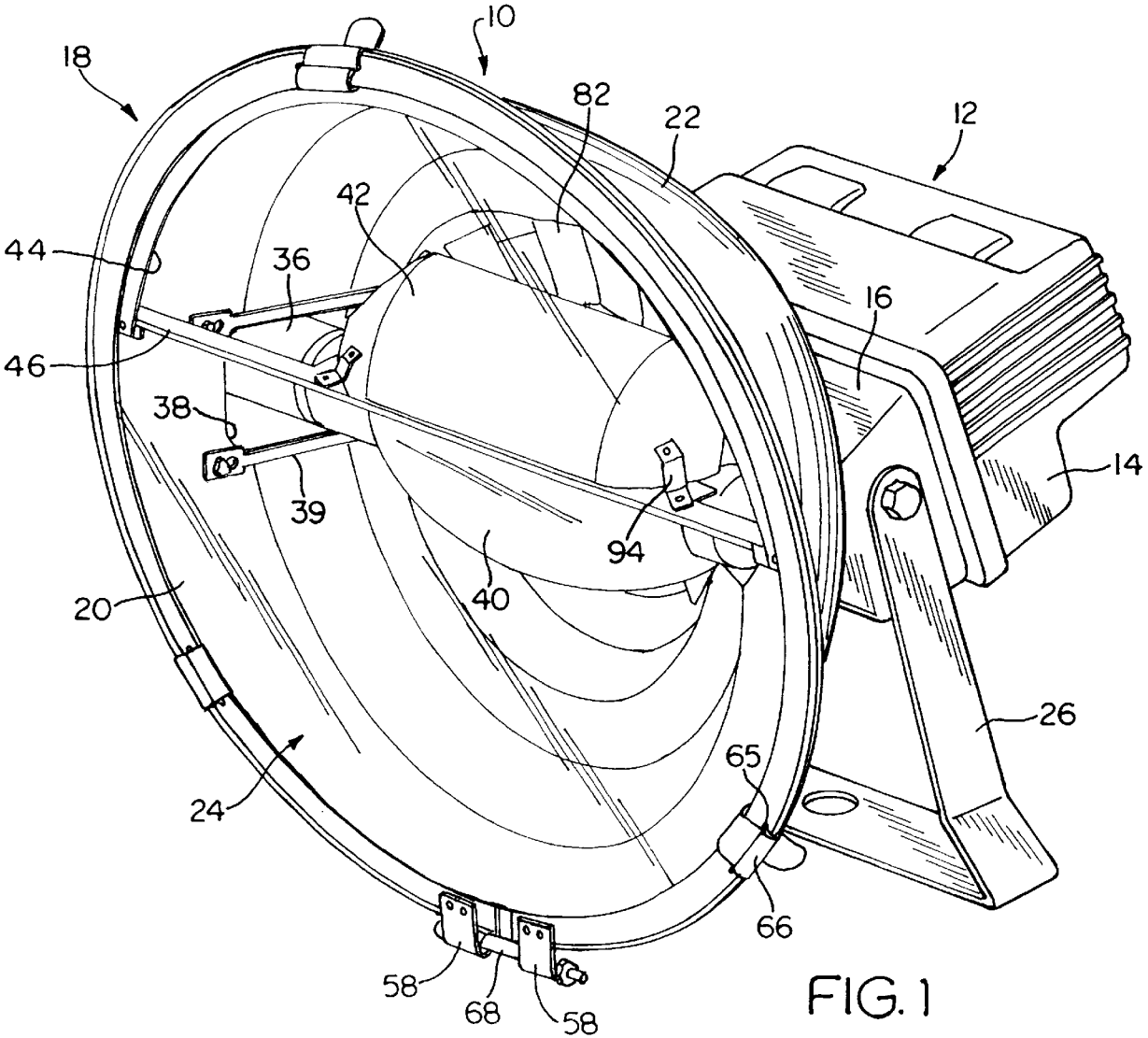
FIG. 1 is a perspective view of a first embodiment of a luminaire apparatus of the invention, and having a principal reflector configured with annular facets, a flux manager and a reflector insert.
Figure 2:
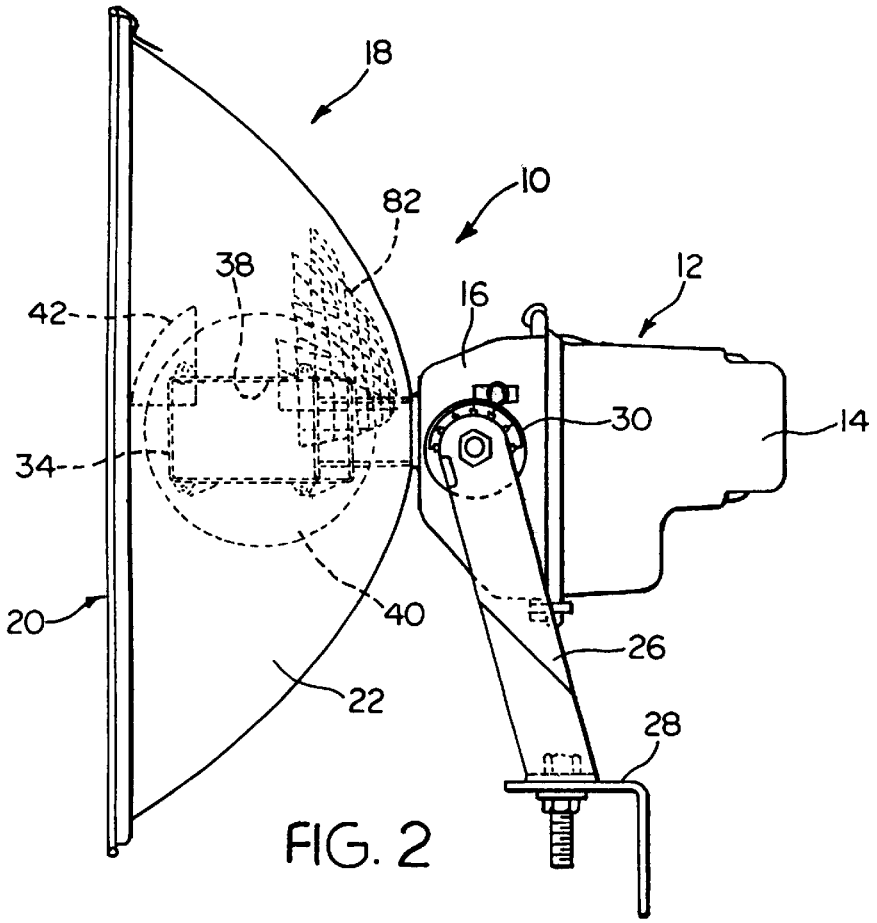
FIG. 2 is a side elevational view of the luminaire apparatus of FIG. 1.
Figure 3:
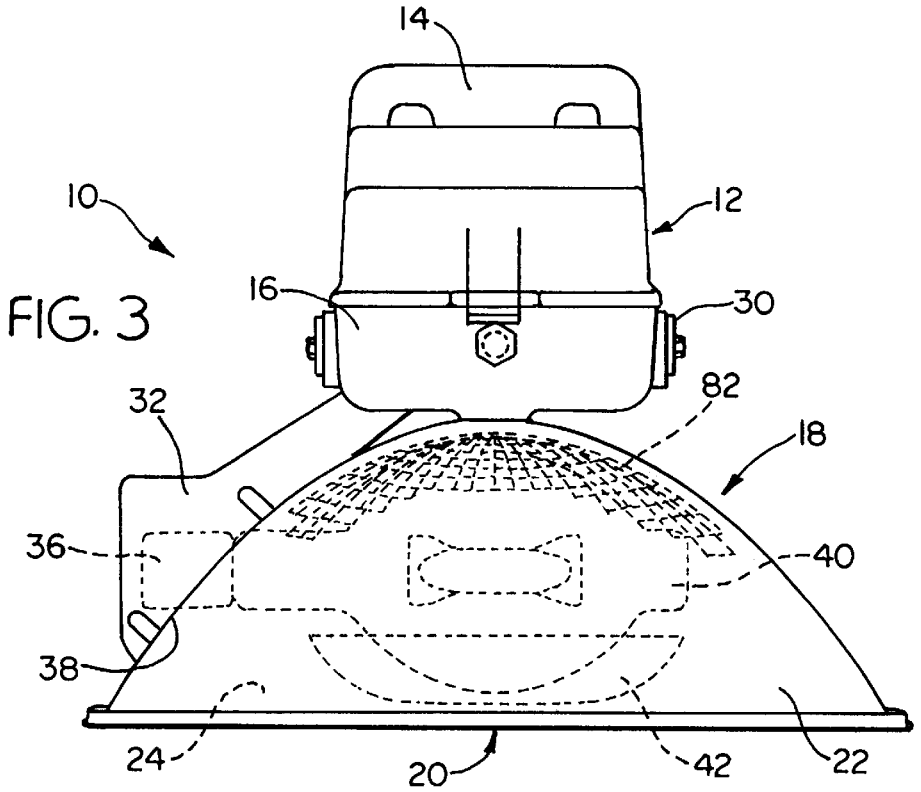
FIG. 3 is a plan view of the luminaire apparatus of FIG. 1.

Referring now to FIGS. 1 through 20 which relate primarily to a sports lighting family of luminaires, it can be seen particularly in FIGS. 1 through 4 that a luminaire assembly 10 is configured to include a substantially weatherproof housing 12 formed of a ballast box 14 and a junction box 16, the luminaire assembly 10 further including a reflector assembly 18 sealed by means of glass lens 20 mounted to the substantially circular periphery of principal reflector 22. The reflector assembly 18 is sealed to prevent entrance of contaminants into an optical chamber 24 defined by the reflector 22. Since the luminaire assembly 10 is intended for outdoor use, it is necessary to seal the reflector assembly 18 by means of the glass lens 20 in a manner which will be described in detail hereinafter. Similarly, in order to house electronics (not shown) including ballast (not shown) and the like within the housing 12, the ballast box 14 and the junction box 16 must seal together in a weatherproof manner and the housing 12 generally must be weatherproof. It is to be understood, however, that the luminaire assembly 12 can be used indoors such as n indoor stadia or the like. Even in an indoor environment, the luminaire assembly 10 is intended to retain weatherproof capabilities in order to positively seal electronics and the like within the housing 12 and to further seal the optical chamber 24 of the reflector assembly 18 in order to prevent degradation of the functioning of electronics within the housing 12 or degradation of the optical operation of the reflector assembly 18 which can be caused by miscellaneous contaminants including water and the like. Accordingly, even though the luminaire assembly 10 may be referred to herein as being an "outdoor" luminaire, it is to be understood that the luminaire assembly 10 can function in both indoor and outdoor environments.

Figures 5A, 5C:
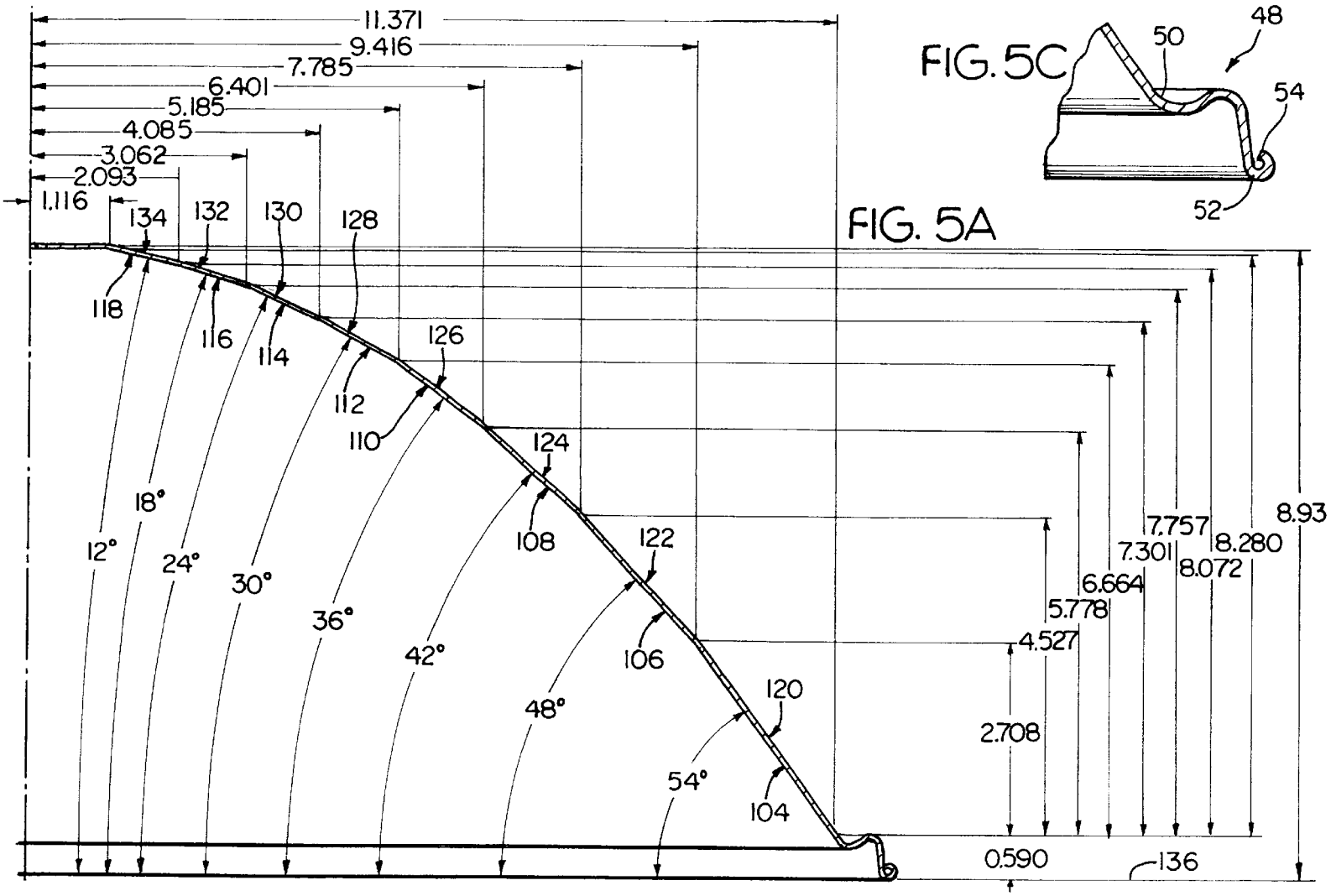
FIG. 5A is a side elevational view in section of one-half of the principal reflector of FIGS. 1 through 4.
FIG. 5C is a detail view in section of a rim portion of the principal reflector of FIGS. 5A and 5B.
Figure 5B:
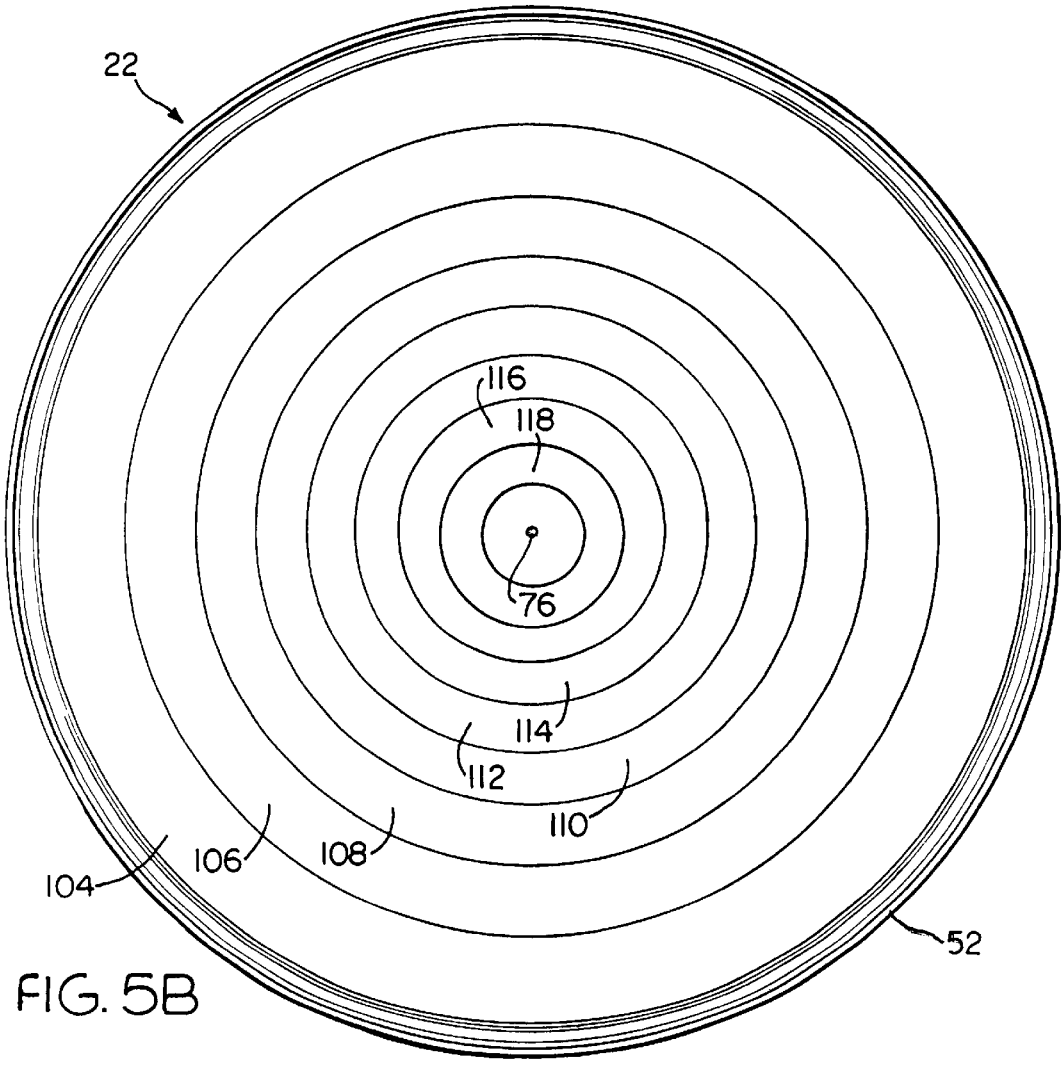
FIG. 5B is a front elevational view of the principal reflector of FIG. 5A.

The principal reflector 22 is formed of a heavy-gauge anodized aluminum material, inner wall surfaces of the reflector 22 primarily defining the optical chamber 24 sealed by means of the glass lens 20. The reflector 22, which is also seen in FIGS. 5A through 5C, has a thickness sufficient to provide the strength and rigidity necessary for functioning of the reflector 22 as the housing for the optical chamber 24 including mounting of the glass lens 20 about the periphery thereof and the supporting of structure including lamping which must be carried by the reflector 22. Further, the reflector 22 must be sufficiently rugged to withstand winds and the like in a use environment. It should be understood that the light reflective inner wall surfaces of the reflector 22 could be formed on a backing of other material with that backing (not shown) being sufficiently rigid and having sufficient strength to accomplish the intended purpose. The housing 12 is preferably formed of die-cast aluminum, the electrical components (not shown) contained within the housing 12 being thermally isolated from the reflector 22 and the interior of the optical chamber 24 as well as thermally isolated from socketry and lamping which will be described hereinafter.

Lamping preferably takes the form of a standard BT-56 jacketed metal halide lamp for wattages of 1000 and 1500 watts, an ED-37 being usable for 400 W. A 750 watt high pressure sodium lamp may also be employed. The lamp is referred to herein as lamp 40 but can take several forms and wattages such as are conventionally manufactured by OSRAM, Phillips, General Electric and Venture inter alia. The lamp 40 is mounted transversely within the optical chamber 24 as will be described hereinafter, the transverse orientation of the lamp 40 creating a small extinction angle when spill light control is desired. This orientation of the lamp 40 maximizes the average tilt factor through typical aiming angles.

The luminaire assembly 10 is further seen to include a trunnion 26 which mounts the housing 12 for pivotal movement necessary for aiming of the luminaire assembly 10, the trunnion 26 further being seen to mount to a bracket 28 for mounting to cooperating structure (not shown) on a pole (not shown) or other structure intended for mounting of the luminaire assembly 10 in an elevated position about the periphery of an athletic field or the like. Although not shown in the drawings, a horizontal aiming scale is typically provided between the trunnion 26 and the bracket 28 to facilitate aiming of the luminaire assembly 10. Further, a vertical aiming scale 30 is seen to be located at the connection of the housing 12 and the trunnion 26 for aiming of the luminaire assembly 10. A socket arm 32 connects to and extends from the junction box 16 of the housing 12 to mount a socket bracket 34 which in turn mounts mogul socket 36, the socket 36 extending through opening 38 into the interior of the reflector assembly 18 to mount the lamp 40. Edge surfaces of the socket arm 32 which contact exterior surfaces of the reflector assembly 18 are flanged (not seen in the drawings) and shaped to conform to outer surfaces of the reflector 22. The socket arm 32 also covers the opening 38 and effectively provides a sealing function with an appropriate gasket (not shown) in the area of the aforesaid flanged portions of the socket arm 32. The socket arm 32 is essentially hollow interiorly and houses electrical connectors, wiring and the like (not shown) which connect to the socket 36 from the interior of the junction box 16 through the socket arm 32. Reinforcing strips 39 disposed on inner wall surfaces of the reflector 22 facilitate mounting of the socket arm 32 to the reflector 22 through use of screws 41. The socket arm 32 thus mounts the lamp 40 with the lamp 40 being disposed in a fixed location transversely within the optical chamber 24 in a predetermined relationship to the reflector 22 and to other portions of the reflector assembly 18 which will be described in detail hereinafter.

While the luminaire assembly 10 includes other functional elements of structure particularly including structure associated with and/or contained within the housing 12, the primary advance in the art afforded by the invention relates to the reflector assembly 18 and thus those remaining portions of structure not described or shown involving the housing 12 including details of the boxes 14, 16 and components associated therewith or contained therein will not be described further herein. It is to be understood that ballast devices (not shown) suitable for operation of the luminaire assembly 12 are known in the art and are devised to be housed by the ballast box 14, for example, and structure such as gaskets (not shown) necessary for sealing of the ballast box 14 to the junction box 16, for example, are also seen to be conventional in the art.

Considering now with continuing reference to FIGS. 1 through 4 and with additional reference to FIGS. 5A through 5C, the reflector assembly 18 is also seen to include a shielding device known herein as a flux manager 42 which is mounted within the optical chamber 24 by means of brackets 44 and 46 respectively substantially at the periphery of the reflector 22 defined by reflector rim 48. A detailed view of the reflector rim 48 is seen in FIG. 5C, the rim 48 including an annular trough 50 defined distally by annular flange 52 having an outwardly turned-up annular edge 54. The glass lens 20 is mounted to the reflector rim 48 by means of a lens ring 56 which is substantially circular in conformation and which is split at one location thereof with riveted screw brackets 58 being located at the free ends of the ring 56 for receipt of a screw 60 which is tightened by torque nut 62 in a conventional manner to mount the glass lens 20. The lens ring 56 is formed either of galvanized material or stainless steel. A lens gasket 64 is disposed about the periphery of the lens 20 and held thereon by the lens ring 56, also in a conventional manner. The lens ring 56 can be provided with spaced slots 65 which receive a portion of a lens ring latch clip 66, the latch clips 66 being regularly disposed about the lens ring 56 as is also conventional in the art. A hinge bracket 68 mounts to the exterior of the reflector assembly 18 by means of a rivet 70 and washer 72, a portion of the hinge bracket 68 fitting between and aligning with portions of the brackets 58 disposed on the lens ring 56 to receive the screw 60 to provide a positive mounting of the lens 20 to the reflector 22.

Centrally of the body of the reflector 22, a flat 74 is formed, the flat having an aperture 76 formed therein for receiving a fastener such as a screw which in combination with fastening structure (not shown) attaches the reflector assembly 18 to the housing 12. Interiorly of the optical chamber 24 and bounding the flat 74, a semi-circular plate-like flat 78 having apertures 80 formed therein mounts a reflector insert 82 by means of pop rivets 84 which are received within aligned apertures 86 formed in the reflector insert 82 and further into the apertures 80 of the flat 78. The reflector insert 82 is mounted in spaced relation to the flat 78 and to inner wall surfaces of the reflector 22.

The flux manager 42 is mounted above a horizontal center line of the reflector 22 by the brackets 44 and 46 referred to hereinabove. The bracket 44 is substantially semi-circular in conformation and mounts immediately inside of the lens 20, the bracket 44 having apertures 88 formed one each at each end thereof, which apertures 88 align with apertures 90 formed at each end of the bracket 46, pop rivets 92 being received through the aligned pairs of apertures 88, 90 to mount the bracket 46 in a location extending substantially across the reflector 22. The bracket 46 effectively lies along the horizontal diameter of the reflector 22, the flux manager 42 being mounted by clips 94 which attach to the flux manager 42 and to the bracket 46 by means of pop rivets 96. The bracket 46 is provided with a central plate 98 having apertures 100 formed near either end thereof to receive the pop rivets 96 for mounting of the flux manager 42, the plate 98 having an arcuate cutout 102 extending over central portions thereof to conform to the shape of adjacent portions of the flux manager 42.

Figure 4:
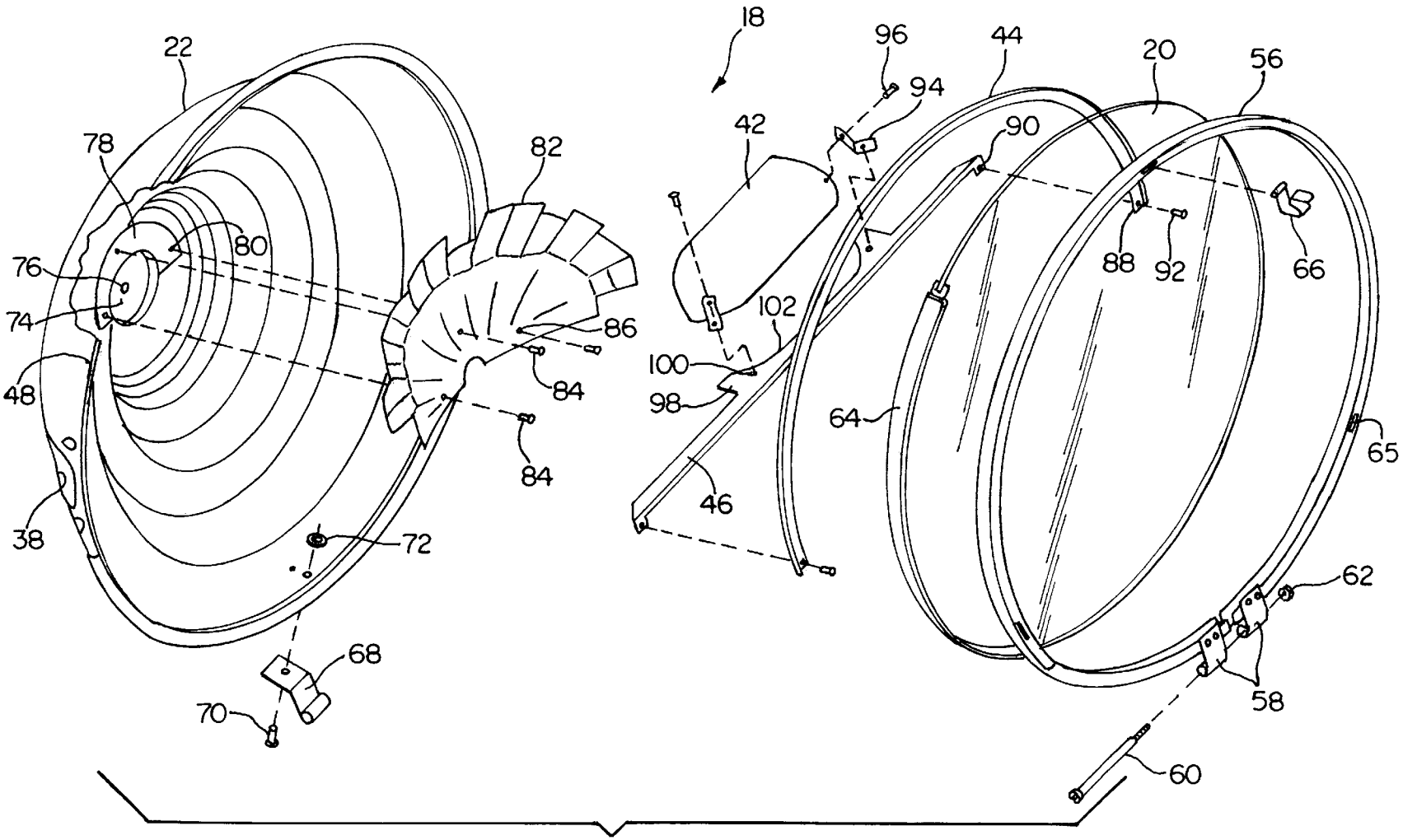
FIG. 4 is an exploded view in perspective of the principal reflector of FIG. 1 configured as a portion of a reflector assembly forming a portion of a luminaire apparatus having a flux manager and a reflector insert disposed within sealed optics of said luminaire apparatus.

Referring particularly to FIGS. 4, 5A and 5B, the reflector 22 is seen to be provided with annular facets 104 through 118 which are essentially concentric. The facets 104 through 118 are defined by segments of the reflector 22 identified as segments 120 through 134, these segments defining the reflector 22 and essentially comprising frusto-conical sections joined at annular perimeters thereof to form the reflector 22, each of the segments 120 through 134 essentially having a linear cross section as is seen in FIG. 5A. FIG. 5A further provides relative dimensions of the segments 120 through 134 for a reflector 22 having a diameter of essentially 24 inches. FIG. 5A also shows the angle of each of the annular facets 104 through 118 relative to a reference line 136, these angles being chosen for optimization of the total reflector output with respect to a desired light distribution. It is to be understood that the relative sizes of the facets 104 through 118 and the angles of the facets 104 through 118 relative to a reference could be produced by formation of a reflector body having outer surfaces which do not take the particular shapes of the segments 120 through 134 but could effectively comprise another shape within which the facets 104 through 118 are formed. However, for ease of manufacture, the segments 120 through 134 comprise exterior surfaces of the reflector 22 and are relatively defined by the vertical and horizontal dimensions in x and y planes as can be inferred from the measurements provided in FIG. 5A. In order that the thickness of the material forming the reflector 22 does not alter the optical characteristics of the reflector 22, the dimensions given are to the inside surfaces of the reflector 22.

Given the optical characteristics of the reflector 22 as provided by the annular facets 104 through 118, it is seen that a shielding device capable of producing a target extinction is desirable and can be provided by the flux manager 42, the flux manager 42 blocking light which would otherwise leave the lamp 40 and produce glare or "spill", In luminaire structures of the prior art, this light is either absorbed by a low reflectance surface or redirected by a diffusing surface. In the present invention, the flux manager 42 optimizes performance of the principal reflector 22. The flux manager 42 is provided with an involute conformation which precisely redirects the light which is blocked as aforesaid and redirects that light past the original arc provided by the lamp 40 to form a second image, this flux then being reflected by the principal reflector 22 into the beam which is directed onto the surface which is to be illuminated. The shape of the flux manager 42 acts to define an extinction angle which begins blocking the arc at 6.25° above center beam and completely blocks the arc at 11°. In other words, the flux manager 42 produces a beam which begins extinguishing at just above 6° above the aiming angle and is totally extinguished at 11°. The flux manager 42 therefore acts as a shielding device which redirects light, which would otherwise be glare, into the beam, thus optimizing light directed onto a playing field or the like by the principal reflector 22. The flux manager 42 essentially produces a virtual arc which is close to the original arc, the virtual arc acting due to the provision of the flux manager 42 as a second source.

Figure 9:
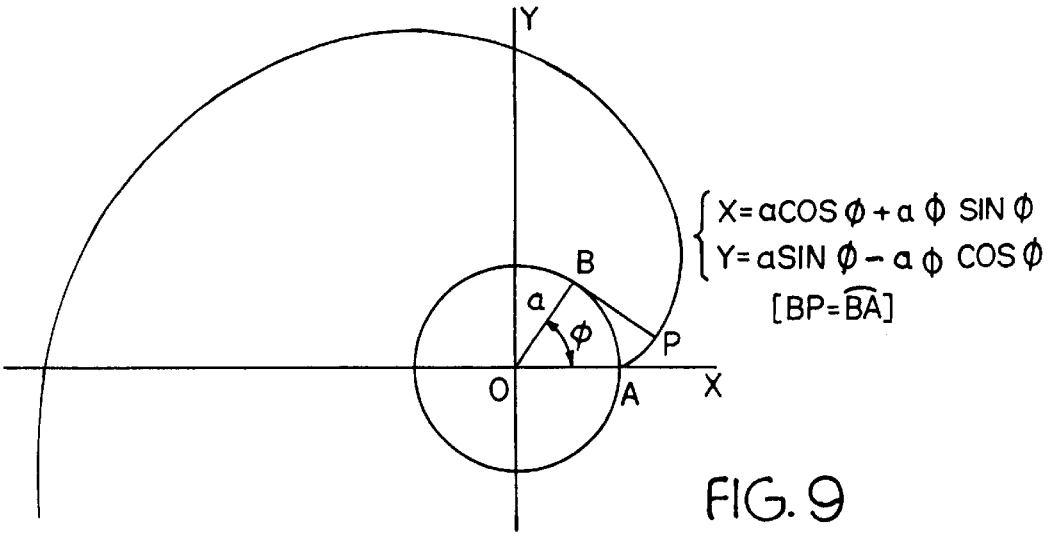
FIG. 9 is a diagram illustrating the geometrical configuration of an involute.
Figure 6C:
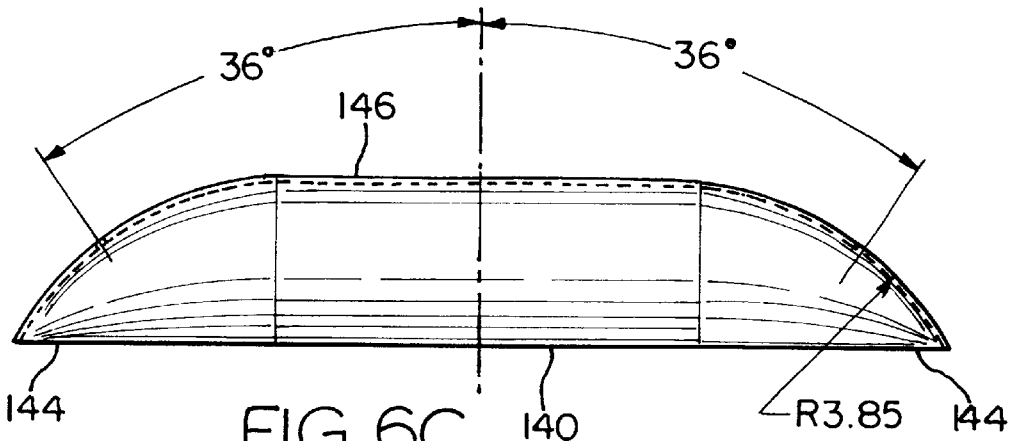
FIGS. 6A through 6E are elevational views of a shielding device or flux manager useful according to the invention.
Figure 6A:
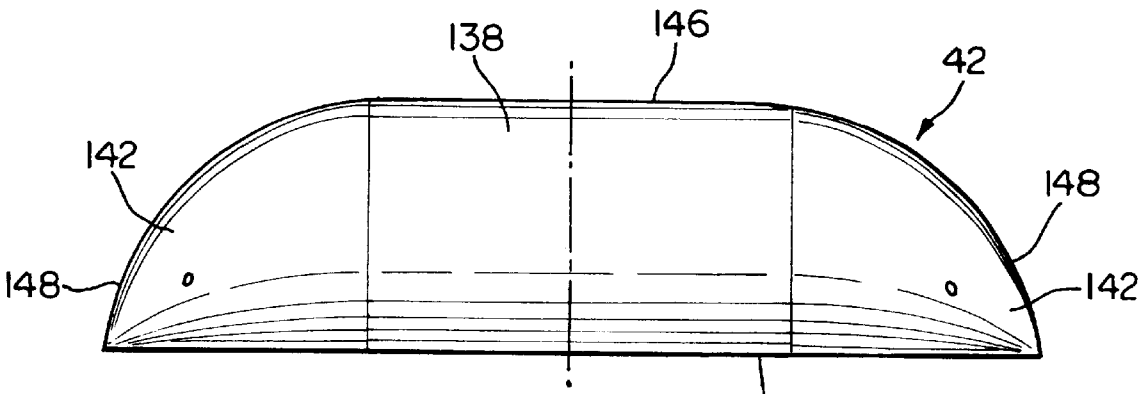
Figure 6D:
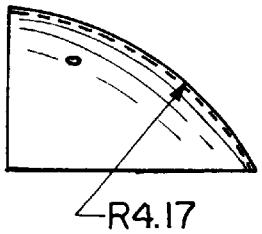
Figure 6B:
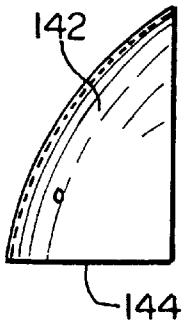
Figure 6E:
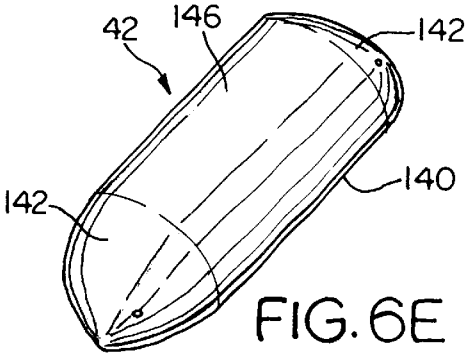
Figure 8:
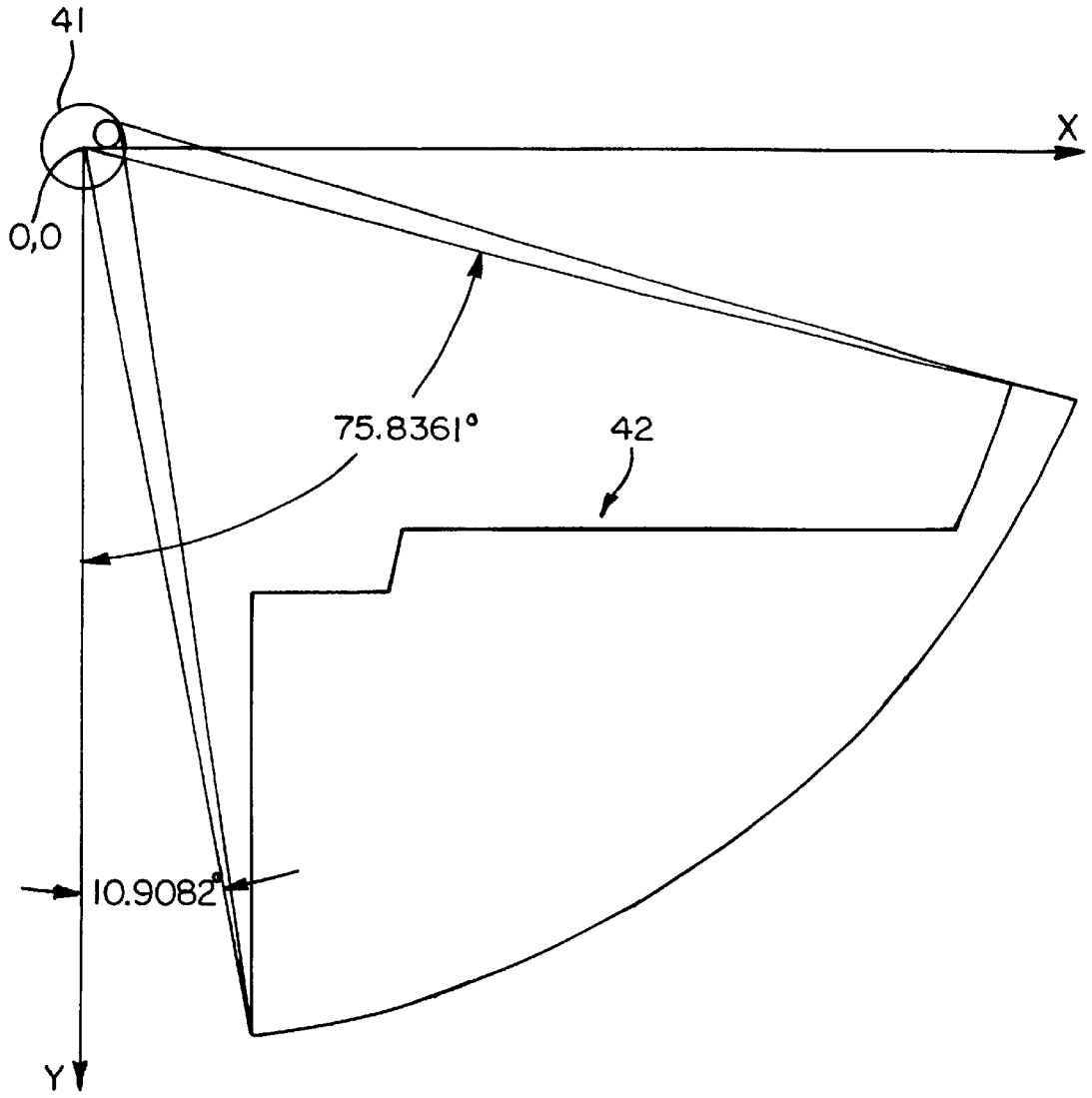
FIG. 8 is a diagram illustrating the geometrical configuration of a flux manager conformed according to the invention.

The particular conformation of the flux manager 42 is seen in FIGS. 6A through 6D and which is more appreciated by reference to FIGS. 8 and 9. The flux manager 42 takes the shape of an involute having the following equation as derived in FIG. 9:

$$x=a\cos\Phi+a\,\Phi\sin\Phi$$

and $$y=a\sin\Phi-a\,\Phi\cos\Phi$$

as related to cartesian coordinates where BP=BA. As seen in FIG. 9, "a" is taken to be the radius of arc tube 41 of the lamp 40, the arc tube 41 being centered in the optical chamber 24. Referring to FIG. 8, the shape of the flux manager 42 is derived in x, y and z with 0,0,0 being the center of the arc tube 41 of the lamp 40 with the center of a circular section being taken as a point on that circle forming the arc tube of the lamp at (0.1381,0.0920) with the radius being taken as (3.6504) for formation of a circular curve. For the dimensions required, an angle of 75.8361° from the y axis is subtended with an angle of 10.9082° being subtracted therefrom, the involute lying therebetween. As might be generally described, the involute which is the flux manager 42 has an arcuate central body portion 138 which is partially defined by a lowermost edge 140 which is substantially a straight line and which is located just above the horizontal centerline of the reflector 22. At either end of the central body portion 138, the flux manager 42 curves outwardly in to directions to form end portions 142 which are nearly spherical sections. The edge 140 of the flux manager 42 curves outwardly to form arcuate edges 144. In essence, the involute which is the flux manager 42 is symmetrical about a line bisecting the lowermost edge 140 and uppermost edge 146. The uppermost edge 146 also is linear and curves near either end thereof to form arcuate edges 148. The arcuate edges 144 and the arcuate edges 148 intersect at outermost ends of the flux manager 42 thus terminating the involute at either end of the flux manager 42. The flux manager 42 is preferably generated as a surface of revolution constructed of an involute in the vertical dimension and an empirical line having an arc at either end in the horizontal direction.

Figure 7C:
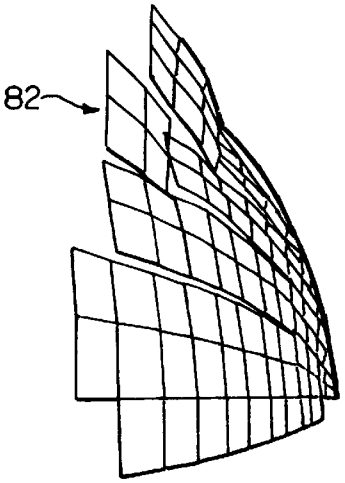
FIGS. 7A through 7C are elevational views of a reflector insert useful according to the invention.
Figure 7B:
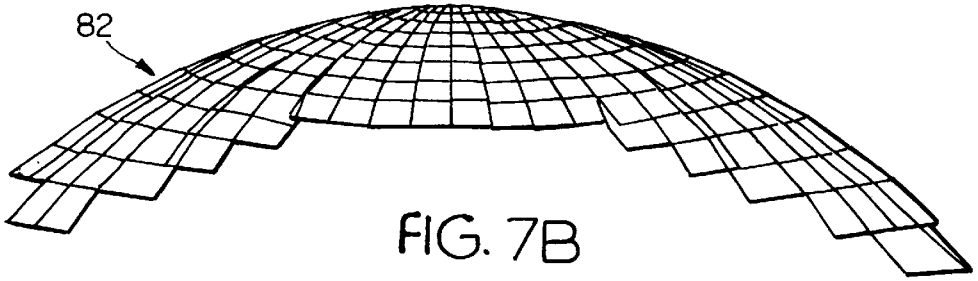
Figure 7A:
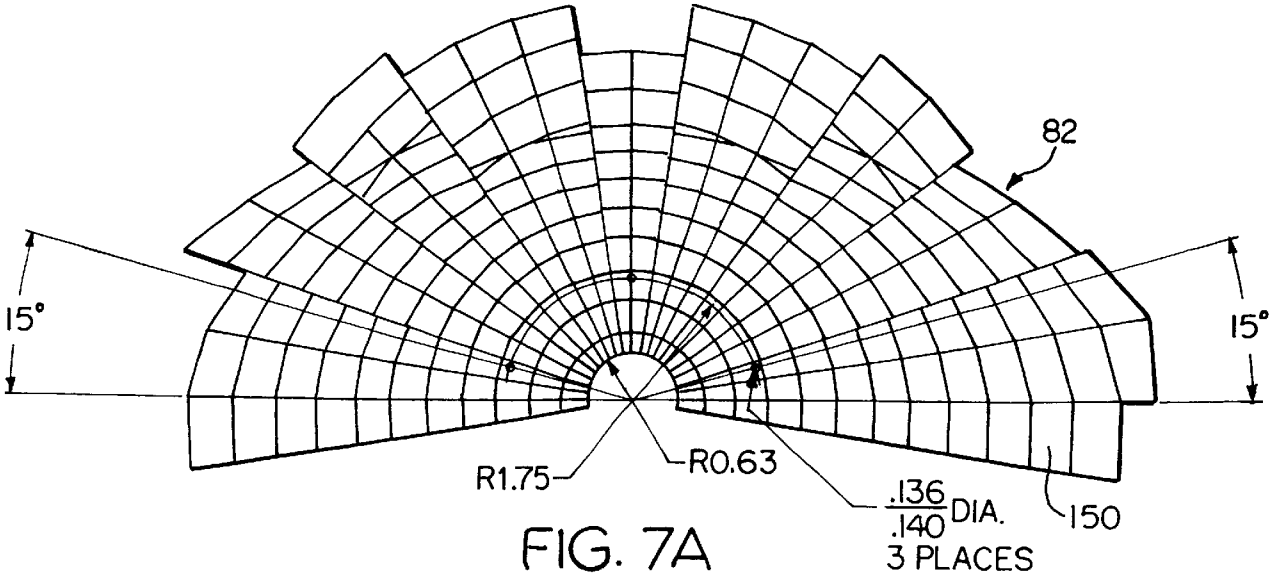

In those embodiments of the invention which utilize the flux manager 42, the reflector insert 82 is also utilized, the structure of the reflector insert 82 being best seen in FIGS. 7A through 7C. The reflector 82 is seen to be comprised of a multiplicity of facets 150 which re-aim light which would have been incident on portions of the reflective surface of the principal reflector 22 and which then would be blocked by the flux manager 42. In essence, the reflector insert 82 causes the flux which would have been impingent on the flux manager 42 to be redirected to exit the optical chamber 24 at the highest possible angle below center beam without striking the flux manager or being incident with the arc of the lamp 40. As an alternative, some light can pass over and some light can pass under. The reflector insert is symmetrical about a centerline except that five facets are removed from one side thereof for mechanical convenience. A principal reflector such as the reflector 22 fitted with the reflector insert 82 and having a diameter of nominally 24 inches would have a reflector insert 82 having a length of approximately 13 inches. The facets 150 are empirically sized and shaped to direct flux incident thereon as aforesaid.

Figure 10:
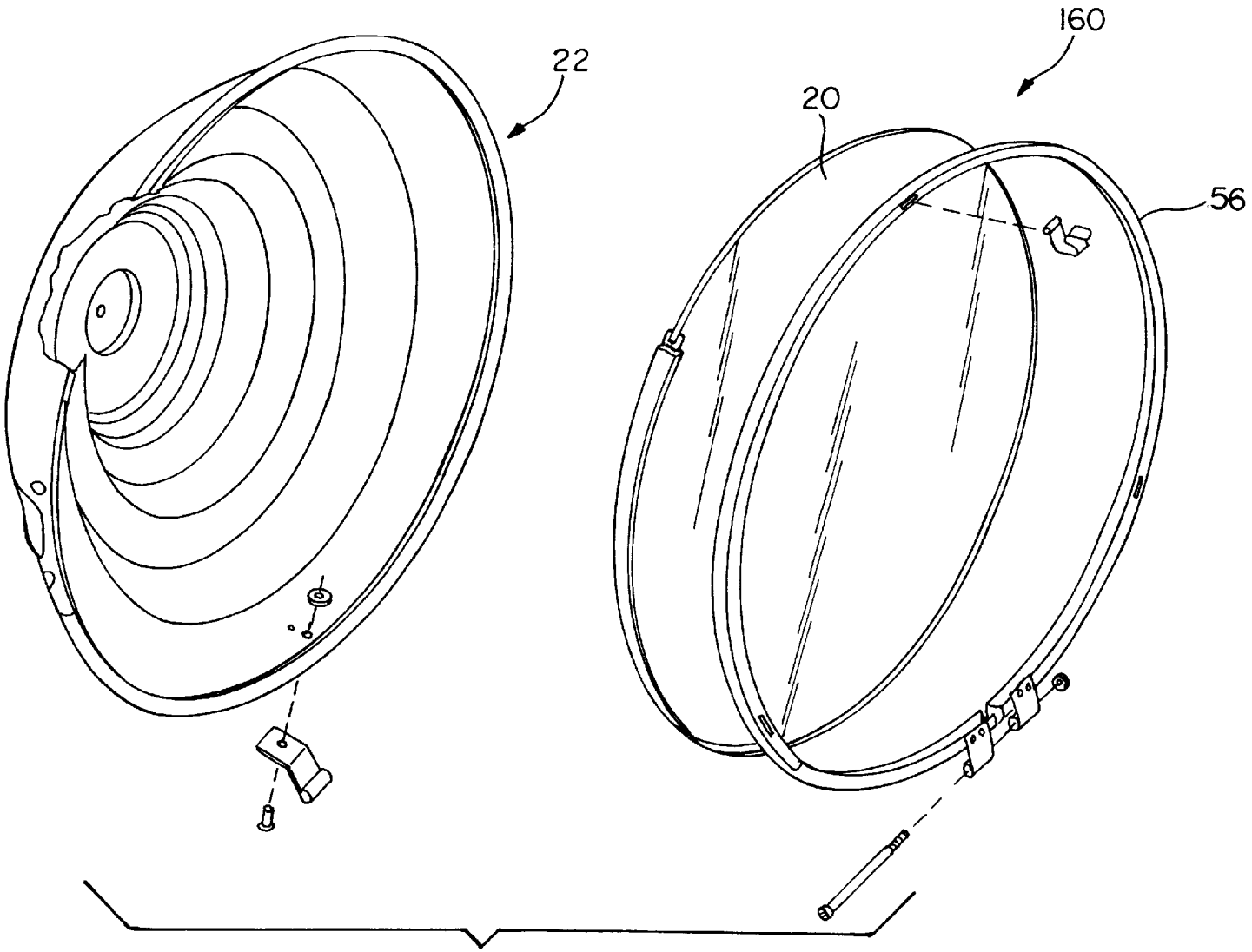
FIG. 10 is a perspective view of a principal reflector of the invention having annular facets in the manner of FIGS. 5A and 5B and having a lens mounted thereto.

The reflector assembly 18 seen in FIGS. 1 through 4 utilizes the principal reflector 22 having the annular facets 104 through 118 as particularly shown in FIG. 5A. The reflector assembly 18 of FIGS. 1 through 4 is provided with the flux manager 42 and the reflector insert 82 to provide the functions described herein. However, the principal reflector 22 can be utilized as seen in FIG. 10 without the addition thereto of the flux manager 42 and the reflector insert 82. In essence, the principal reflector 22 can be sealed by means of the glass lens 20 and the lens ring 56 inter alia with the principal reflector 22 being mounted to a housing such as the housing 12 of FIG. 1 inter alia, thereby providing a reflector assembly 160. For ease of illustration, the reflector assembly 160 is shown without the complication of a housing such as the housing 12 of FIG. 1 inter alia. The reflector assembly 160 provides a desirable distribution of light to a playing field or the like albeit with some loss of lamp lumen output to glare or "spill."

Figure 11:
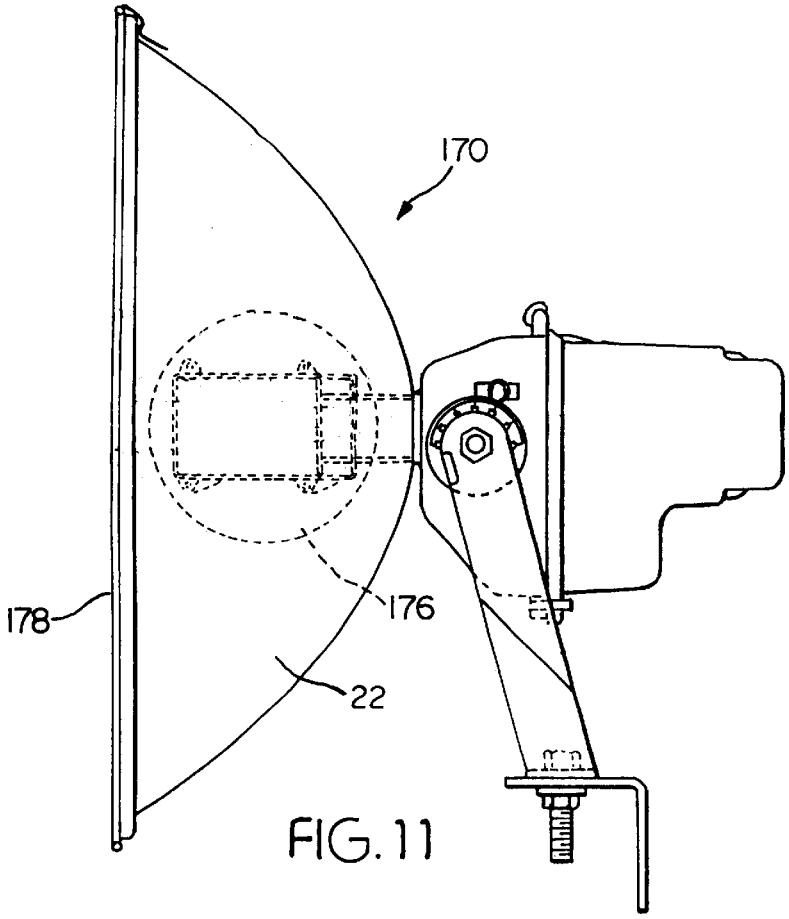
FIG. 11 is a side elevational view of an embodiment of the invention using the principal reflector assembly of FIG. 10 on the optical structure of the luminaire as shown.
Figure 12:
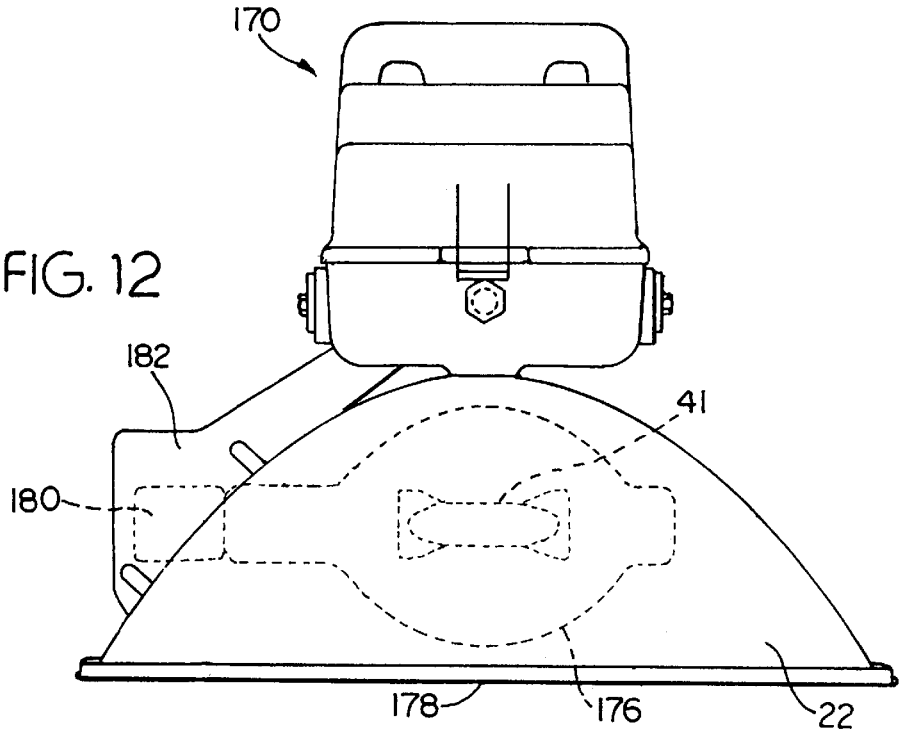
FIG. 12 is a plan view of the luminaire of FIG. 11.

FIGS. 11 and 12 illustrate a luminaire assembly 170 having lamp 176 mounted transversely within optical chamber 174 defined by principal reflector 176 and sealed by lens 178 as aforesaid relative to the mounting of the lens 20 to the principal reflector 22. The lamp 172 is seen to be mounted by socket 180 which is a porcelain mogul base socket having a copper alloy nickel plate screw shell and center contact (not shown), the socket 180 being listed for up to 1500 watts at 600 volts and rated for 5 KV pulses. The socket 180 essentially takes the same form as the mogul socket 36 described herein relative to the luminaire assembly 10. The luminaire assembly 170 is illustrated in order to not only show in a simplified illustration the mounting of the lamp 172 by means of the socket 180 carried by die-cast aluminum socket arm 182, but also to point out that the several principal reflectors described herein can be utilized in a luminaire assembly such as the luminaire assembly 170 which does not utilize a shielded device such as the flux manager 42 or an internal reflector such as the reflector insert 82. In essence, the luminaire assembly 170 could take the form of the principal reflector 22 having the annular facets 104 through 118 or could take the form of principal reflector 190 of FIGS. 13 and 14 or principal reflector 200 of FIGS. 15 and 16 inter alia, the principal reflectors 190 and 200 being described hereinafter.

Figure 13:
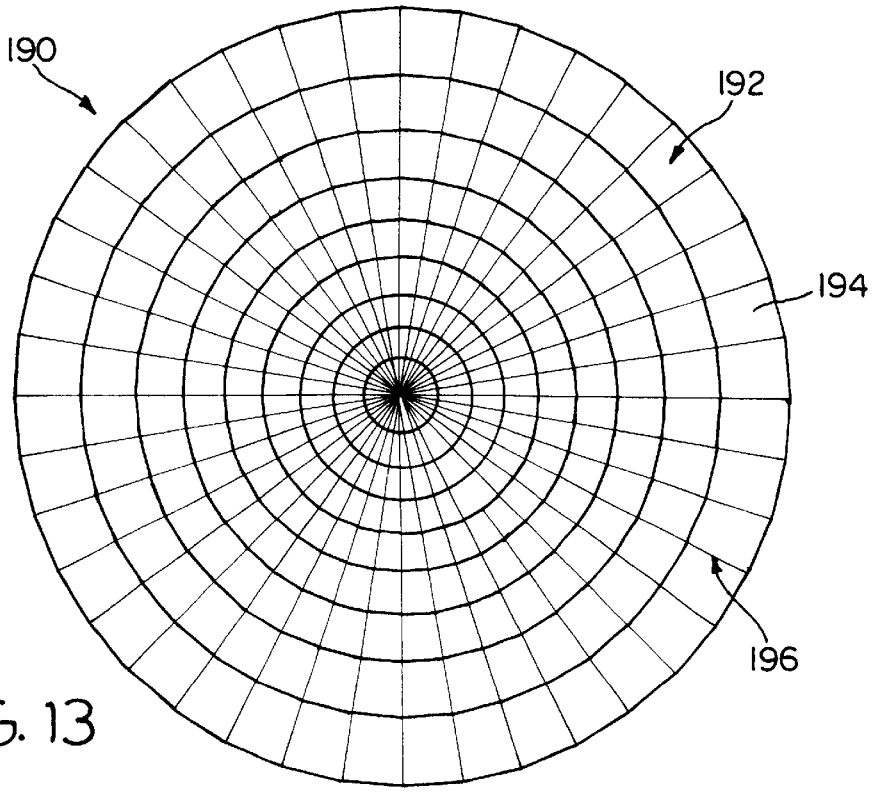
FIG. 13 is a front elevational view of a principal reflector of the invention having multiple regularly-arranged facets.
Figure 14:
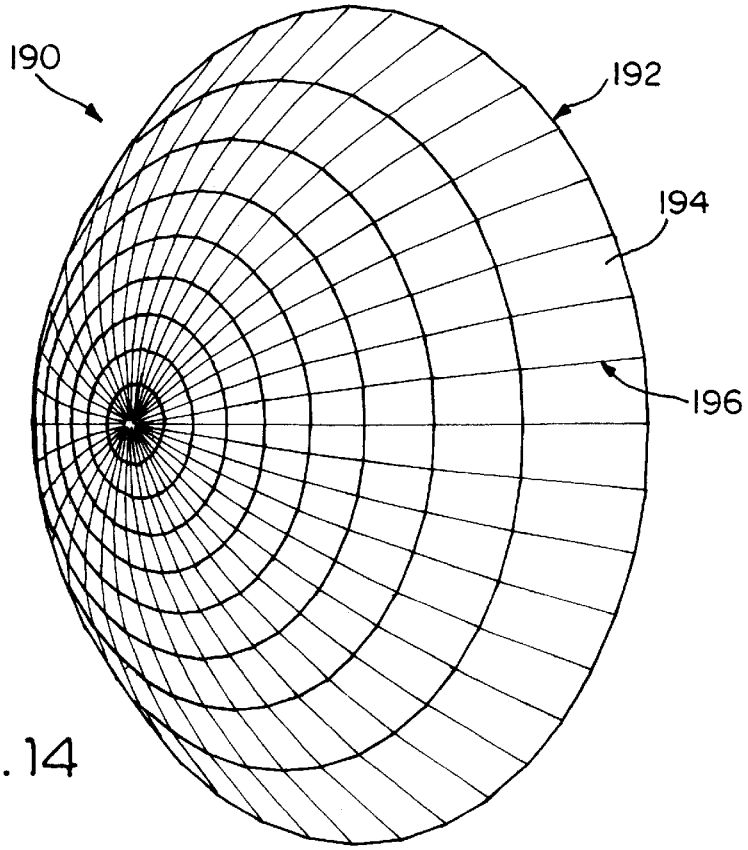
FIG. 14 is a perspective view of the principal reflector of FIG. 13.

Referring now to FIGS. 13 and 14, the principal reflector 190 is seen to be formed with annular concentric arrays 192 of facets 194, each array 192 corresponding to the similarly located segments 120 through 134 of FIG. 5A. Each array 192 is broken down into the facets 194 of each array by virtue of forty radial lune segments 196 which extend from the geometric center of the principal reflector 190 to cause each of the annular concentric arrays 192 to comprise forty of the facets 194. A differing number of the lune segments 196 could be employed, the number chosen being suitable for manufacturing convenience and reflector performance. As is readily appreciated from a consideration of FIGS. 13 and 14, the facets 194 on the outermost array 192 have a different area and configuration relative to the facets 194 on those arrays 192 located progressively inwardly of the principal reflector 190. For simplicity of illustration, only the principal reflector 190 is shown in FIGS. 13 and 14. As aforesaid, the principal reflector 190 can be placed into the luminaire assembly 170 of FIGS. 11 and 12 in order to form a luminaire assembly utilizing the principal reflector 190. Similarly, the principal reflector 190 can substitute for the principal reflector 22 in the luminaire assembly 10 and thus be utilized in combination with the flux manage 42 and the reflector insert 82. The facets 194 are each essentially planar.

Figure 15:
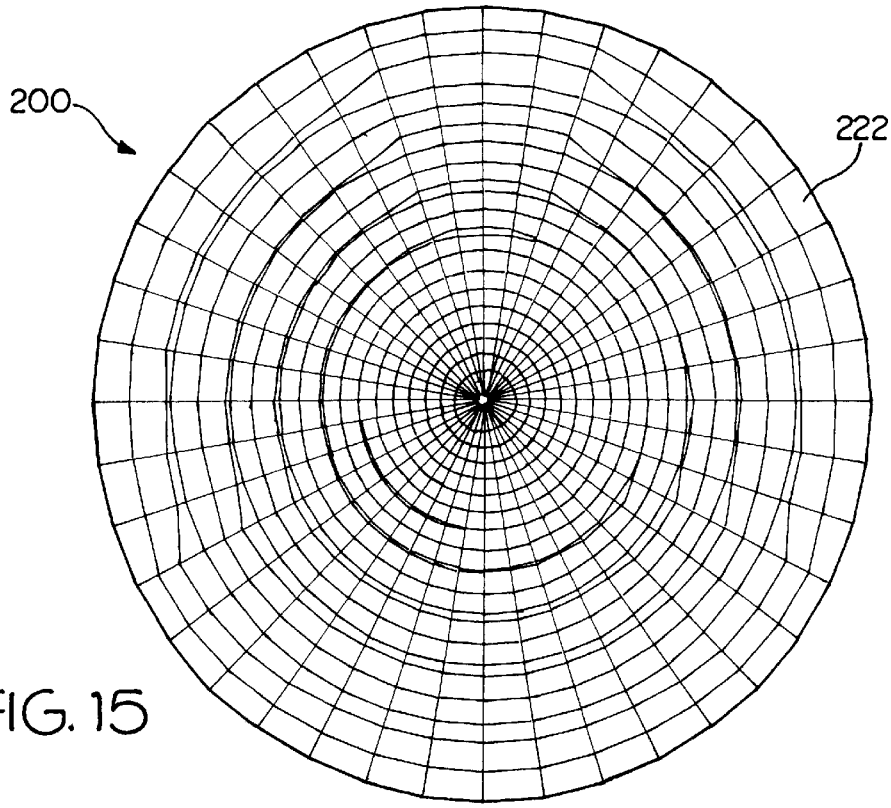
FIG. 15 is a front elevation view of a multi-faceted principal reflector of the invention having all facets thereof aimed to create a desired light distribution.
Figure 16:
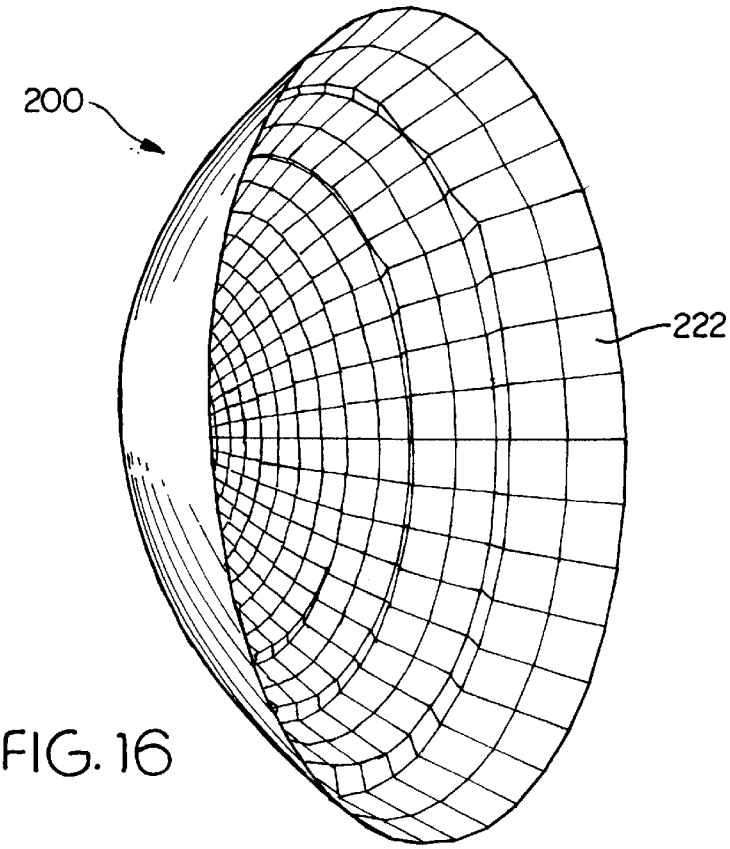
FIG. 16 is a perspective view of the principal reflector of FIG. 15.
Figure 17A:
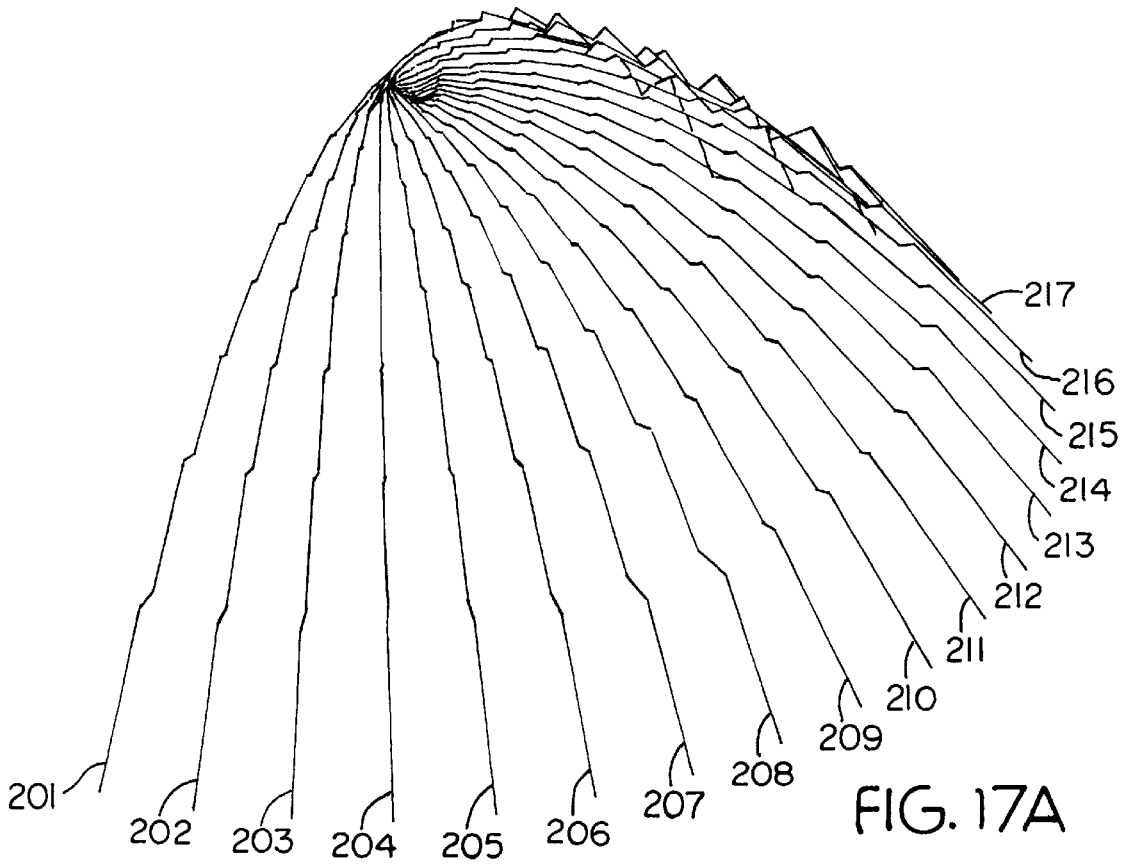
FIG. 17A is a diagram illustrating lune segments of the principal reflector of FIG. 15.
Figure 17B:
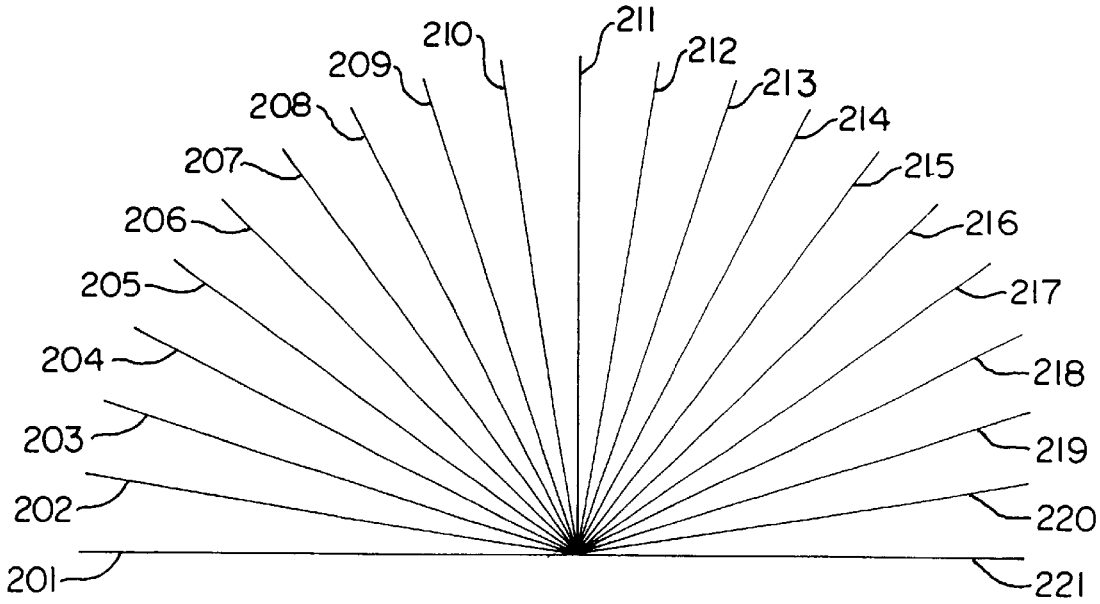
FIG. 17B is a diagram of the numbered lune segments forming the reflector of FIGS. 15 and 16.
Figure 18A:
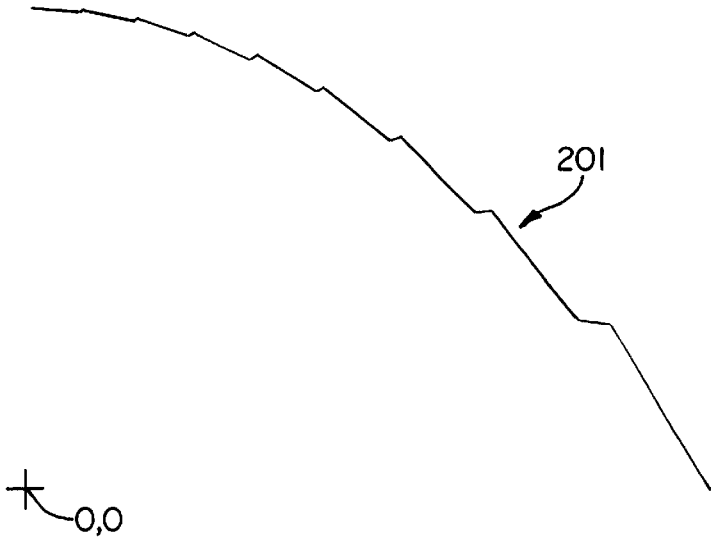
FIGS. 18A through 18U are diagrams illustrating respectively lines 1 through 21 of the reflector of FIGS. 15 and 16.
Figure 18B:
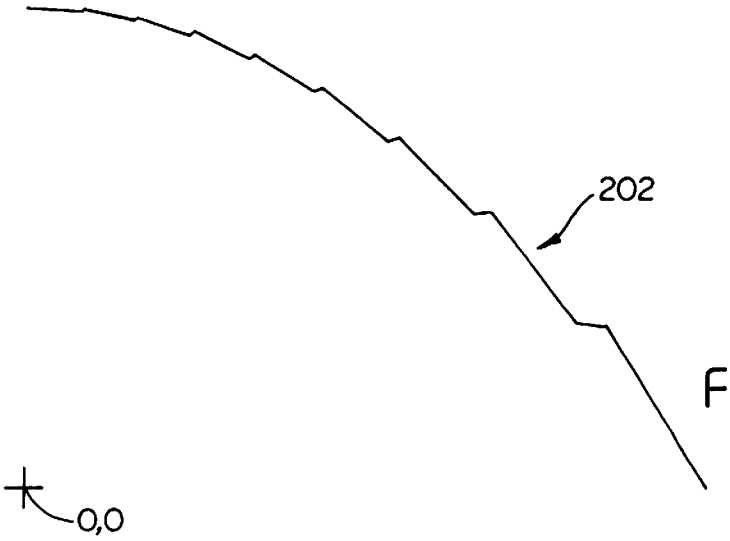
Figure 18C:
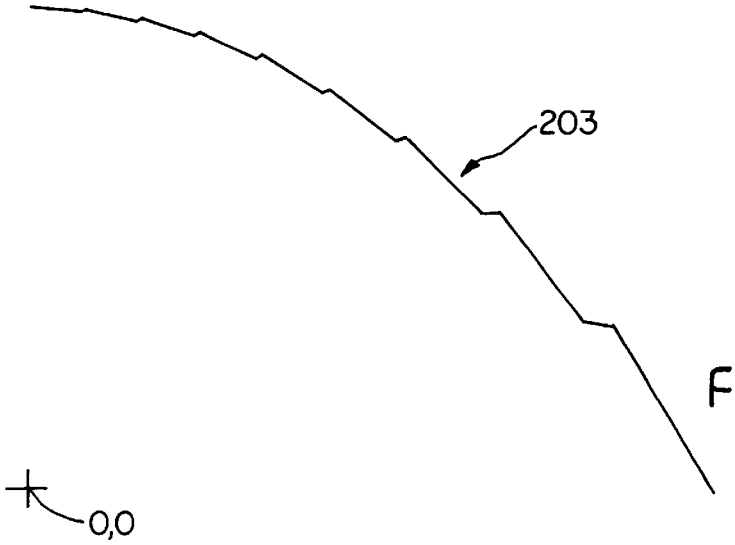
Figure 18D:
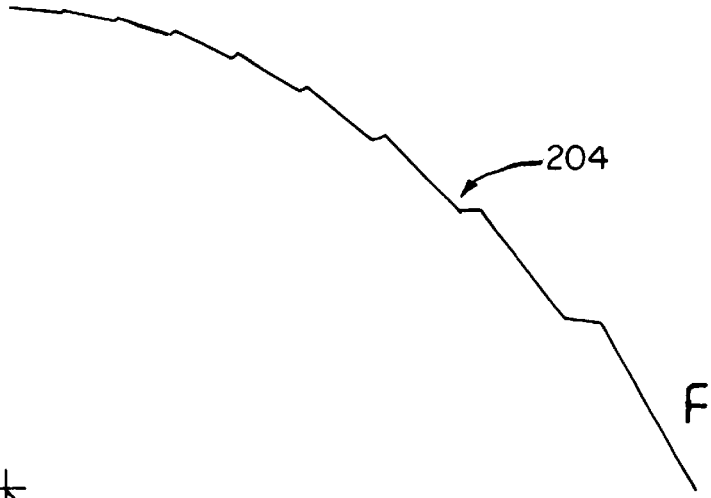
Figure 18E:
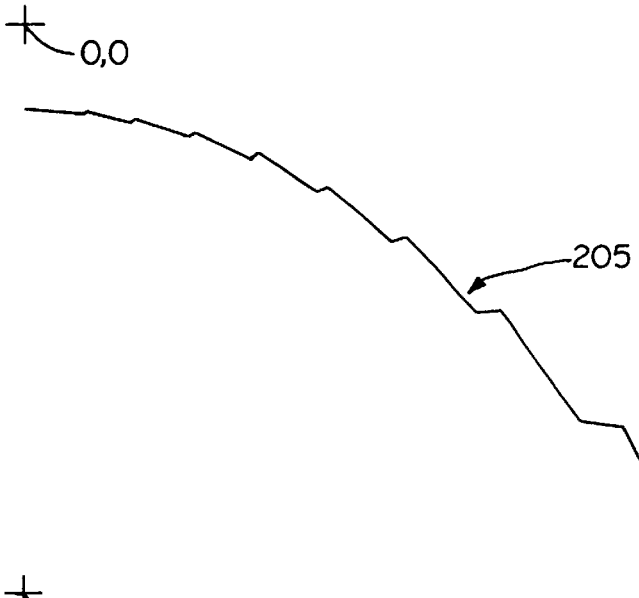
Figure 18F:
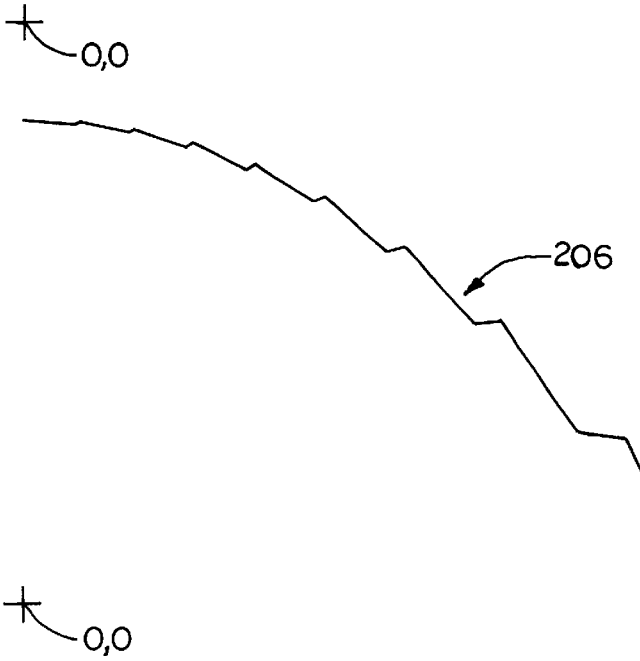
Figure 18G:
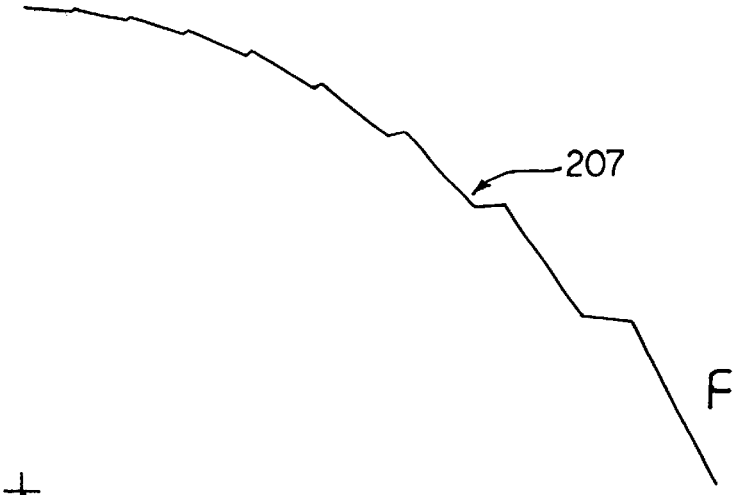
Figure 18H:
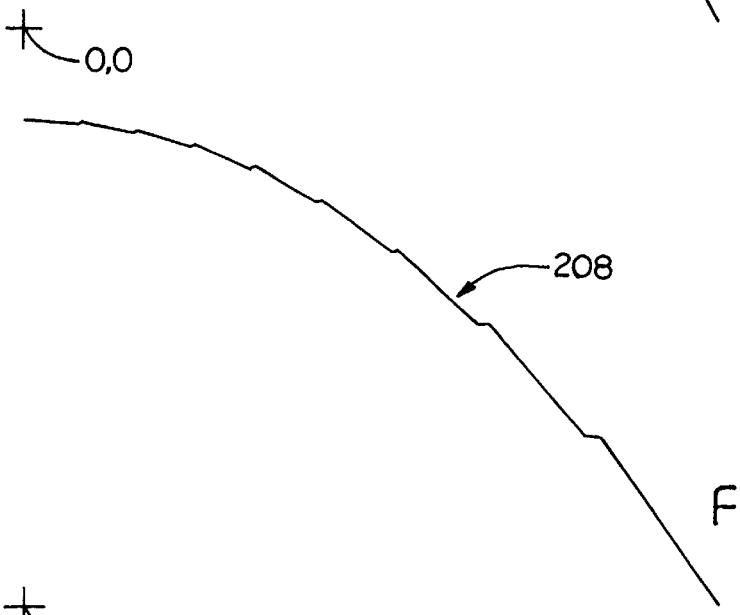
Figure 18I:
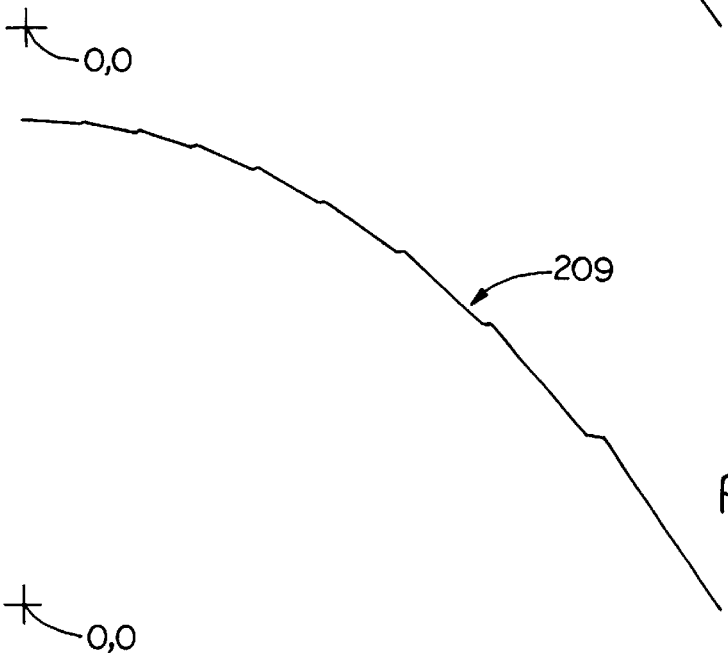
Figure 18J:
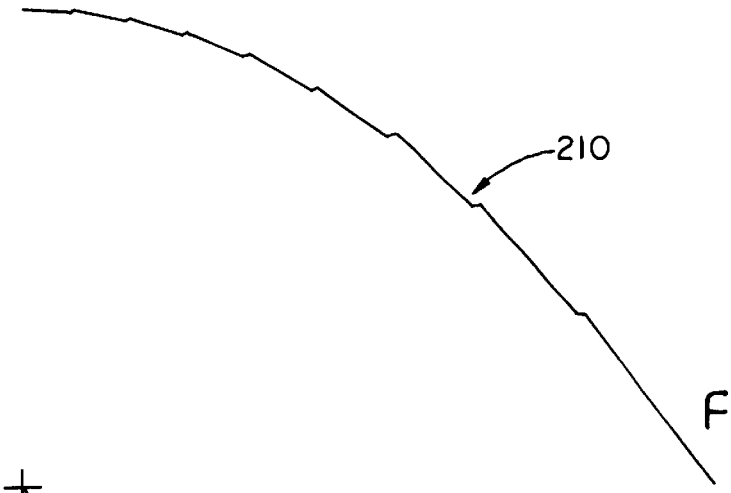
Figure 18K:
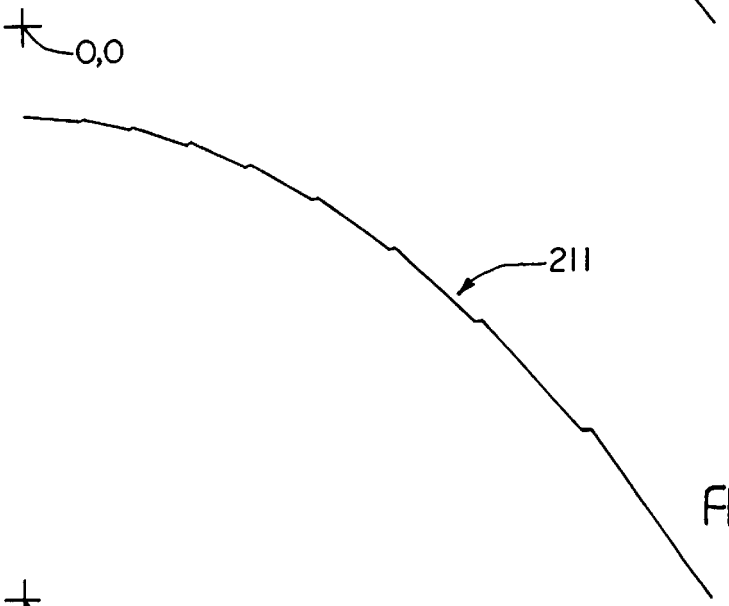
Figure 18L:
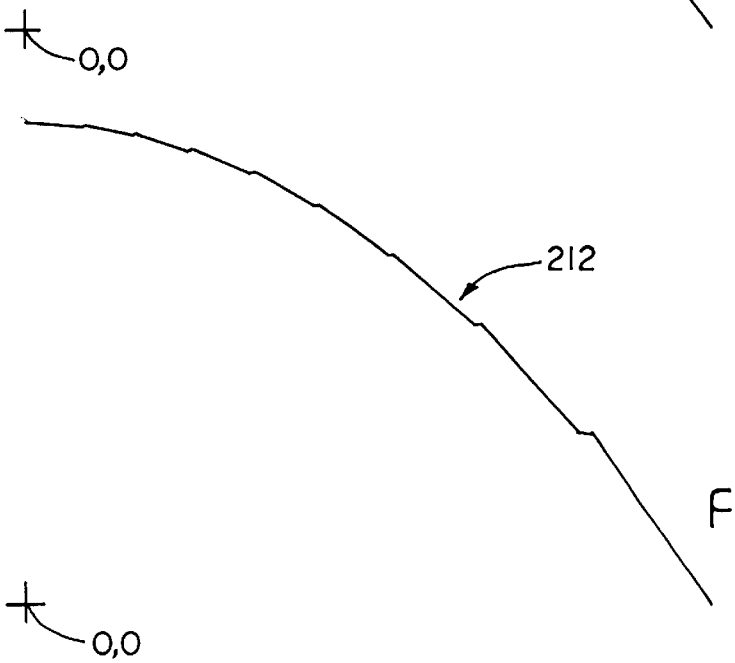
Figure 18M:
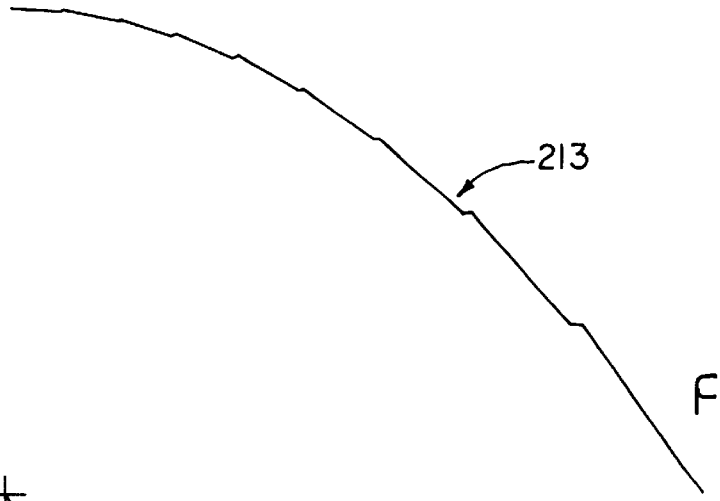
Figure 18N:
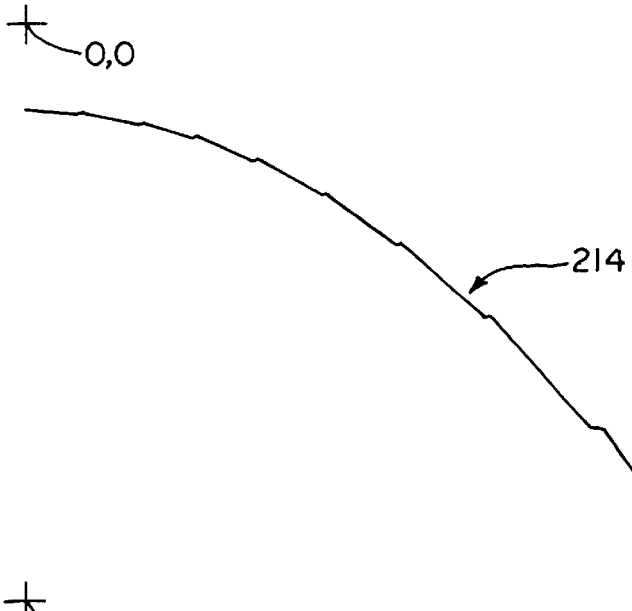
Figure 18O:
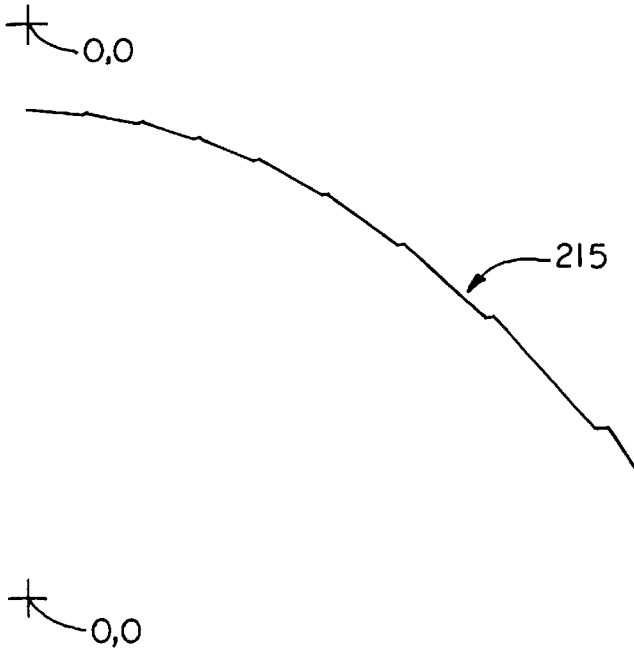
Figure 18P:
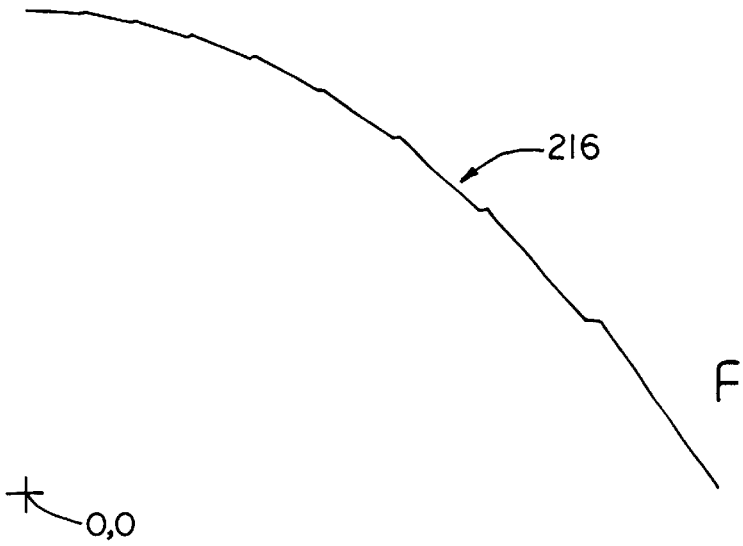
Figure 18Q:
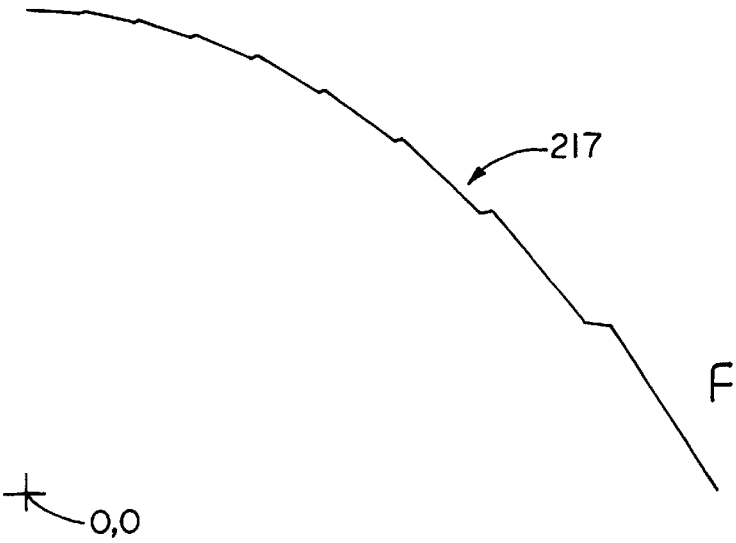
Figure 18R:
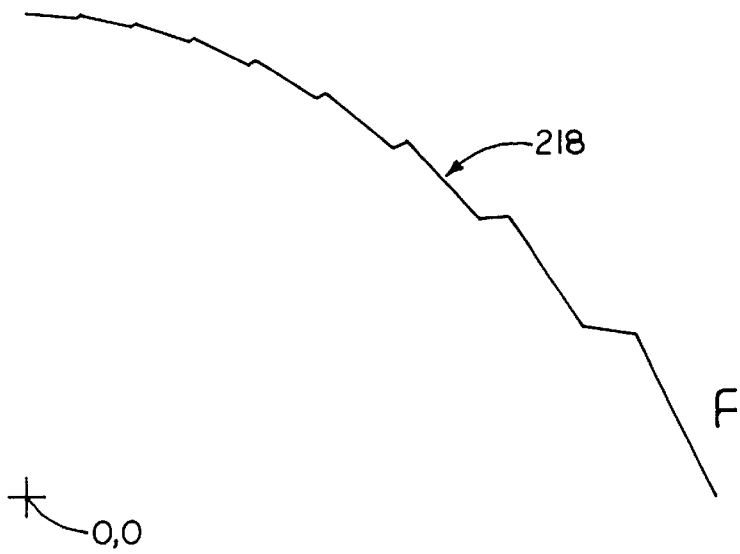
Figure 18S:
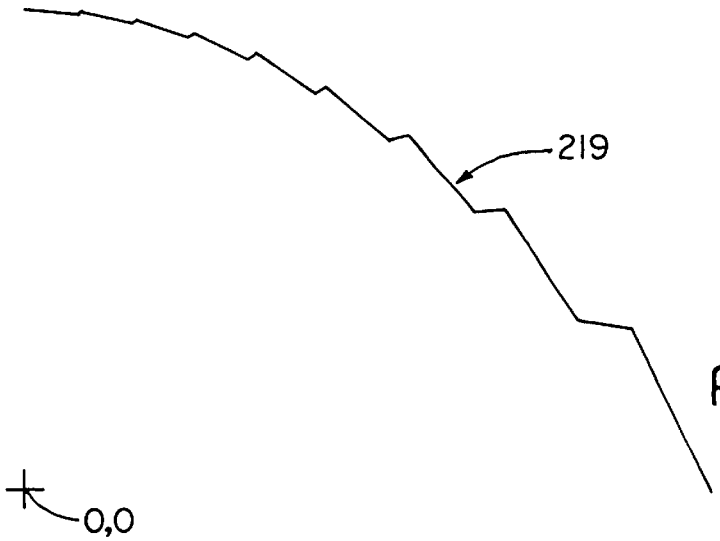
Figure 18T:
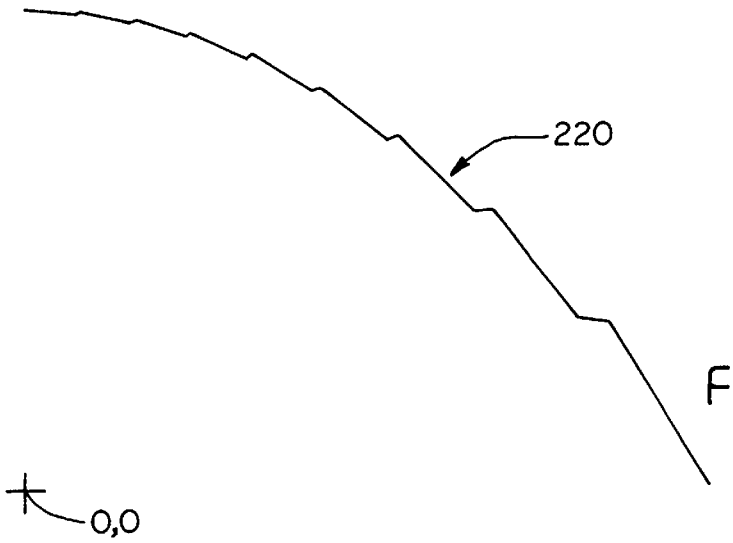
Figure 18U:
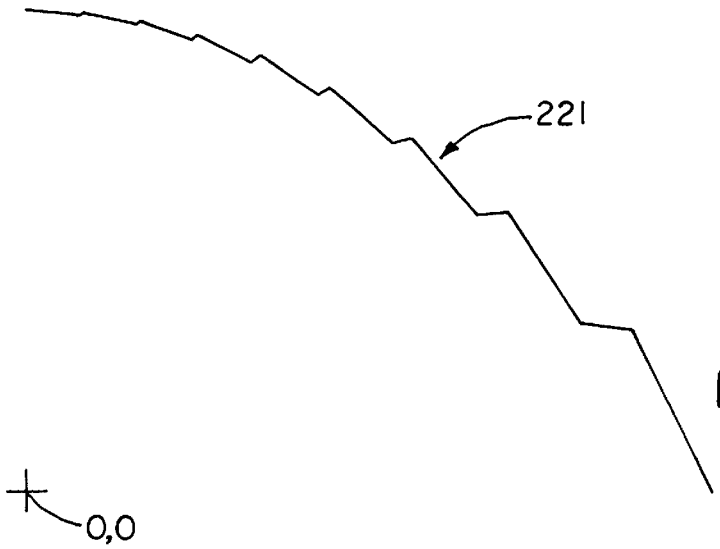

Referring now to FIGS. 15 and 16, the principal reflector 200 is seen to be formed of a multiplicity of facets 222 which are of irregular configuration and formed as will be described hereinafter. Essentially, each facet 222 of the principal reflector 200 is aimed in order to provide a desired light distribution and performance. The aiming of each of the facets 222 puts flux in the bottom of the beam as is the intent of the invention as described above. The principal reflector 200 shown in FIGS. 15 and 16 can substitute for the reflector of FIGS. 11 and 12 to form a luminaire assembly as aforesaid. The facets 222 of the principal reflector 190 are defined by twenty-one lune segments identified as lune segments 201, 202 . . . 221 as identified in FIGS. 17A and 17B. The lune segments 201 through 221 essentially having the conformation suggested in FIG. 17A and being fully defined in FIGS. 18A through 18U which provide the shape of each of the twenty-one lune segments. The shape of each of the lune segments 201 through 221 is provided by definition of points as cartesian coordinates in x and y as shown in FIGS. 18A through 18U, the points being connected to form the lune segments 201 through 221 and then cross-connected to define inner reflective surfaces, that is, the facets 222 of the principal reflector 200 for one-half of the inner reflective surfaces of said reflector 200. The other half of the reflector 200 are formed according to the lune segments 201 through 221 on an opposite half of the reflector 200 across a vertical centerline. In essence, the inner reflective surfaces of the reflector 200 are mirror images across the vertical centerline.

As noted above, FIGS. 18A through 18U are diagrams illustrating the cross-sectional shapes of each of the lune segments 201 through 221 in x and y coordinates with x and y dimensions being provided by relative reference in the following Tables I through XXI which correspond respectively to lune segments 201 through 221.

TABLE I

| Lune Segment 201 | |
|---|---|
| X | Y |
| 11.328 | 0.000 |
| 9.641 | 2.717 |
| 9.107 | 2.782 |
| 7.691 | 4.573 |
| 7.394 | 4.547 |
| 6.159 | 5.784 |
| 5.977 | 5.728 |
| 4.873 | 6.602 |
| 4.758 | 6.538 |
| 3.751 | 7.161 |
| 3.665 | 7.086 |
| 2.728 | 7.521 |
| 2.681 | 7.459 |
| 1.796 | 7.751 |
| 1.776 | 7.709 |
| 0.919 | 7.883 |
| 0.914 | 7.859 |
| 0.070 | 7.929 |
| 0.000 | 7.931 |

TABLE II

| Lune Segment 202 | |
|---|---|
| X | Y |
| 11.328 | 0.000 |
| 9.641 | 2.717 |
| 9.107 | 2.782 |
| 7.689 | 4.573 |
| 7.394 | 4.547 |

TABLE II-continued

| Lune Segment 202 | |
|---|---|
| X | Y |
| 6.158 | 5.783 |
| 5.977 | 5.728 |
| 4.872 | 6.601 |
| 4.758 | 6.538 |
| 3.749 | 7.160 |
| 3.665 | 7.086 |
| 2.728 | 7.521 |
| 2.681 | 7.459 |
| 1.795 | 7.750 |
| 1.776 | 7.709 |
| 0.919 | 7.881 |
| 0.914 | 7.859 |
| 0.070 | 7.929 |
| 0.000 | 7.931 |

TABLE III

| Lune Segment 203 | |
|---|---|
| X | Y |
| 11.328 | 0.000 |
| 9.635 | 2.717 |
| 9.107 | 2.782 |
| 7.684 | 4.573 |
| 7.394 | 4.547 |
| 6.157 | 5.783 |
| 5.977 | 5.728 |
| 4.872 | 6.601 |
| 4.758 | 6.538 |
| 3.747 | 7.157 |
| 3.665 | 7.086 |
| 2.727 | 7.519 |
| 2.681 | 7.459 |
| 1.795 | 7.749 |
| 1.776 | 7.709 |
| 0.919 | 7.881 |
| 0.914 | 7.859 |
| 0.070 | 7.929 |
| 0.000 | 7.931 |

TABLE IV

| Lune Segment 204 | |
|---|---|
| X | Y |
| 11.328 | 0.000 |
| 9.725 | 2.706 |
| 9.107 | 2.782 |
| 7.742 | 4.578 |
| 7.394 | 4.547 |
| 6.189 | 5.793 |
| 5.977 | 5.728 |
| 4.894 | 6.613 |
| 4.758 | 6.538 |
| 3.760 | 7.169 |
| 3.665 | 7.086 |
| 2.733 | 7.527 |
| 2.681 | 7.459 |
| 1.797 | 7.754 |
| 1.776 | 7.709 |
| 0.920 | 7.884 |
| 0.914 | 7.859 |
| 0.070 | 7.929 |
| 0.000 | 7.931 |

TABLE V

| Lune Segment 205 | |
|---|---|
| X | Y |
| 11.328 | 0.000 |
| 9.812 | 2.696 |
| 9.107 | 2.782 |
| 7.394 | 4.583 |
| 7.795 | 4.547 |
| 6.227 | 5.804 |
| 5.977 | 5.728 |
| 4.913 | 6.624 |
| 4.758 | 6.538 |
| 3.772 | 7.179 |
| 3.665 | 7.086 |
| 2.739 | 7.535 |
| 2.681 | 7.459 |
| 1.799 | 7.758 |
| 1.776 | 7.709 |
| 0.920 | 7.886 |
| 0.914 | 7.859 |
| 0.070 | 7.930 |
| 0.000 | 7.931 |

TABLE VI

| Lune Segment 206 | |
|---|---|
| X | Y |
| 11.328 | 0.000 |
| 9.894 | 2.686 |
| 9.107 | 2.782 |
| 7.855 | 4.588 |
| 7.394 | 4.547 |
| 6.265 | 5.816 |
| 5.977 | 5.728 |
| 4.936 | 6.637 |
| 4.758 | 6.538 |
| 3.779 | 7.186 |
| 3.665 | 7.086 |
| 2.740 | 7.537 |
| 2.681 | 7.459 |
| 1.799 | 7.758 |
| 1.776 | 7.709 |
| 0.920 | 7.888 |
| 0.914 | 7.859 |
| 0.070 | 7.929 |
| 0.000 | 7.931 |

TABLE VII

| Lune Segment 207 | |
|---|---|
| X | Y |
| 11.328 | 0.000 |
| 9.933 | 2.681 |
| 9.107 | 2.782 |
| 7.880 | 4.590 |
| 7.394 | 4.547 |
| 6.260 | 5.814 |
| 5.977 | 5.728 |
| 4.897 | 6.615 |
| 4.758 | 6.538 |
| 3.754 | 7.164 |
| 3.665 | 7.086 |
| 2.728 | 7.521 |
| 2.681 | 7.459 |
| 1.795 | 7.749 |
| 1.776 | 7.709 |
| 0.919 | 7.881 |
| 0.914 | 7.859 |

TABLE VII-continued

| Lune Segment 207 | |
|---|---|
| X | Y |
| 0.070 | 7.928 |
| 0.000 | 7.931 |

TABLE VIII

| Lune Segment 208 | |
|---|---|
| X | Y |
| 11.328 | 0.000 |
| 9.378 | 2.749 |
| 9.107 | 2.782 |
| 7.543 | 4.560 |
| 7.394 | 4.547 |
| 6.076 | 5.758 |
| 5.977 | 5.728 |
| 4.819 | 6.572 |
| 4.758 | 6.538 |
| 3.721 | 7.135 |
| 3.665 | 7.086 |
| 2.713 | 7.501 |
| 2.681 | 7.459 |
| 1.788 | 7.734 |
| 1.776 | 7.709 |
| 0.917 | 7.873 |
| 0.914 | 7.859 |
| 0.070 | 7.925 |
| 0.000 | 7.931 |

TABLE IX

| Lune Segment 209 | |
|---|---|
| X | Y |
| 11.328 | 0.000 |
| 9.368 | 2.750 |
| 9.107 | 2.782 |
| 7.506 | 4.557 |
| 7.394 | 4.547 |
| 6.068 | 5.756 |
| 5.977 | 5.728 |
| 4.819 | 6.572 |
| 4.758 | 6.538 |
| 3.720 | 7.134 |
| 3.665 | 7.086 |
| 2.713 | 7.501 |
| 2.681 | 7.459 |
| 1.787 | 7.733 |
| 1.776 | 7.709 |
| 0.917 | 7.873 |
| 0.914 | 7.859 |
| 0.070 | 7.923 |
| 0.000 | 7.931 |

TABLE X

| Lune Segment 210 | |
|---|---|
| X | Y |
| 11.328 | 0.000 |
| 9.230 | 2.767 |
| 9.107 | 2.782 |
| 7.522 | 4.559 |
| 7.394 | 4.547 |
| 6.150 | 5.781 |
| 5.977 | 5.728 |

TABLE X-continued

| Lune Segment 210 | |
|---|---|
| X | Y |
| 4.822 | 6.574 |
| 4.758 | 6.538 |
| 3.723 | 7.137 |
| 3.665 | 7.086 |
| 2.713 | 7.501 |
| 2.681 | 7.459 |
| 1.788 | 7.736 |
| 1.776 | 7.709 |
| 0.917 | 7.873 |
| 0.914 | 7.859 |
| 0.070 | 7.925 |
| 0.000 | 7.931 |

TABLE XI

| Lune Segment 211 | |
|---|---|
| X | Y |
| 11.328 | 0.000 |
| 9.334 | 2.754 |
| 9.107 | 2.782 |
| 7.506 | 4.557 |
| 7.394 | 4.547 |
| 6.068 | 5.756 |
| 5.977 | 5.728 |
| 4.814 | 6.569 |
| 4.758 | 6.538 |
| 3.715 | 7.130 |
| 3.665 | 7.086 |
| 2.710 | 7.497 |
| 2.681 | 7.459 |
| 1.787 | 7.733 |
| 1.776 | 7.709 |
| 0.917 | 7.871 |
| 0.914 | 7.859 |
| 0.070 | 7.923 |
| 0.000 | 7.931 |

TABLE XII

| Lune Segment 212 | |
|---|---|
| X | Y |
| 11.328 | 0.000 |
| 9.340 | 2.754 |
| 9.107 | 2.782 |
| 7.506 | 4.557 |
| 7.394 | 4.547 |
| 6.043 | 5.748 |
| 5.977 | 5.728 |
| 4.807 | 6.565 |
| 4.758 | 6.538 |
| 3.709 | 7.125 |
| 3.665 | 7.086 |
| 2.707 | 7.493 |
| 2.681 | 7.459 |
| 1.786 | 7.730 |
| 1.776 | 7.709 |
| 0.916 | 7.869 |
| 0.914 | 7.859 |
| 0.070 | 7.922 |
| 0.000 | 7.931 |

TABLE XIII

| Lune Segment 213 | |
|---|---|
| X | Y |
| 11.328 | 0.000 |
| 9.339 | 2.754 |
| 9.107 | 2.782 |
| 7.516 | 4.558 |
| 7.394 | 4.547 |
| 6.043 | 5.748 |
| 5.977 | 5.728 |
| 4.807 | 6.565 |
| 4.758 | 6.538 |
| 3.713 | 7.128 |
| 3.665 | 7.086 |
| 2.707 | 7.493 |
| 2.681 | 7.459 |
| 1.787 | 7.732 |
| 1.776 | 7.709 |
| 0.916 | 7.869 |
| 0.914 | 7.859 |
| 0.070 | 7.922 |
| 0.000 | 7.931 |

TABLE XIV

| Lune Segment 214 | |
|---|---|
| X | Y |
| 11.328 | 0.000 |
| 9.340 | 2.754 |
| 9.107 | 2.782 |
| 7.514 | 4.558 |
| 7.394 | 4.547 |
| 6.043 | 5.748 |
| 5.977 | 5.728 |
| 4.807 | 6.565 |
| 4.758 | 6.538 |
| 3.708 | 7.124 |
| 3.665 | 7.086 |
| 2.707 | 7.493 |
| 2.681 | 7.459 |
| 1.785 | 7.729 |
| 1.776 | 7.709 |
| 0.916 | 7.869 |
| 0.914 | 7.859 |
| 0.070 | 7.922 |
| 0.000 | 7.931 |

TABLE XV

| Lune Segment 215 | |
|---|---|
| X | Y |
| 11.328 | 0.000 |
| 9.361 | 2.751 |
| 9.107 | 2.782 |
| 7.516 | 4.558 |
| 7.394 | 4.547 |
| 6.051 | 5.750 |
| 5.977 | 5.728 |
| 4.807 | 6.565 |
| 4.758 | 6.538 |
| 3.710 | 7.126 |
| 3.665 | 7.086 |
| 2.707 | 7.493 |
| 2.681 | 7.459 |
| 1.785 | 7.729 |
| 1.776 | 7.709 |
| 0.916 | 7.868 |
| 0.914 | 7.859 |
| 0.070 | 7.922 |

TABLE XV-continued

| Lune Segment 215 | |
|---|---|
| X | Y |
| 0.000 | 7.931 |

TABLE XVI

| Lune Segment 216 | |
|---|---|
| X | Y |
| 11.328 | 0.000 |
| 9.380 | 2.749 |
| 9.107 | 2.782 |
| 7.528 | 4.559 |
| 7.394 | 4.547 |
| 6.060 | 5.753 |
| 5.977 | 5.728 |
| 4.808 | 6.566 |
| 4.758 | 6.538 |
| 3.714 | 7.129 |
| 3.665 | 7.086 |
| 2.707 | 7.493 |
| 2.681 | 7.459 |
| 1.786 | 7.731 |
| 1.776 | 7.709 |
| 0.916 | 7.868 |
| 0.914 | 7.859 |
| 0.070 | 7.922 |
| 0.000 | 7.931 |

TABLE XVII

| Lune Segment 217 | |
|---|---|
| X | Y |
| 11.328 | 0.000 |
| 9.546 | 2.728 |
| 9.107 | 2.782 |
| 7.605 | 4.566 |
| 7.394 | 4.547 |
| 6.098 | 5.765 |
| 5.977 | 5.728 |
| 4.832 | 6.579 |
| 4.758 | 6.538 |
| 3.723 | 7.137 |
| 3.665 | 7.086 |
| 2.713 | 7.501 |
| 2.681 | 7.459 |
| 1.787 | 7.733 |
| 1.776 | 7.709 |
| 0.917 | 7.873 |
| 0.914 | 7.859 |
| 0.070 | 7.926 |
| 0.000 | 7.931 |

TABLE XVIII

| Lune Segment 218 | |
|---|---|
| X | Y |
| 11.328 | 0.000 |
| 9.983 | 2.675 |
| 9.107 | 2.782 |
| 7.891 | 4.591 |
| 7.394 | 4.547 |
| 6.249 | 5.811 |
| 5.977 | 5.728 |
| 4.899 | 6.616 |

TABLE XVIII-continued

| Lune Segment 218 | |
|---|---|
| X | Y |
| 4.758 | 6.538 |
| 3.755 | 7.165 |
| 3.665 | 7.086 |
| 2.727 | 7.520 |
| 2.681 | 7.459 |
| 1.794 | 7.747 |
| 1.776 | 7.709 |
| 0.918 | 7.878 |
| 0.914 | 7.859 |
| 0.070 | 7.927 |
| 0.000 | 7.931 |

TABLE XIX

| Lune Segment 219 | |
|---|---|
| X | Y |
| 11.328 | 0.000 |
| 9.993 | 2.673 |
| 9.107 | 2.782 |
| 7.914 | 4.593 |
| 7.394 | 4.547 |
| 6.298 | 5.826 |
| 5.977 | 5.728 |
| 4.944 | 6.641 |
| 4.758 | 6.538 |
| 3.779 | 7.186 |
| 3.665 | 7.086 |
| 2.739 | 7.536 |
| 2.681 | 7.459 |
| 1.798 | 7.757 |
| 1.776 | 7.709 |
| 0.920 | 7.884 |
| 0.914 | 7.859 |
| 0.070 | 7.929 |
| 0.000 | 7.931 |

TABLE XX

| Lune Segment 220 | |
|---|---|
| X | Y |
| 11.328 | 0.000 |
| 9.641 | 2.717 |
| 9.107 | 2.782 |
| 7.693 | 4.574 |
| 7.394 | 4.547 |
| 6.165 | 5.785 |
| 5.977 | 5.728 |
| 4.875 | 6.603 |
| 4.758 | 6.538 |
| 3.752 | 7.162 |
| 3.665 | 7.086 |
| 2.729 | 7.522 |
| 2.681 | 7.459 |
| 1.796 | 7.751 |
| 1.776 | 7.709 |
| 0.919 | 7.883 |
| 0.914 | 7.859 |
| 0.070 | 7.928 |
| 0.000 | 7.931 |

TABLE XXI

| Lune Segment 221 | |
|---|---|
| X | Y |
| 11.328 | 0.000 |
| 9.996 | 2.673 |
| 9.107 | 2.782 |
| 7.918 | 4.593 |
| 7.394 | 4.547 |
| 6.306 | 5.828 |
| 5.977 | 5.728 |
| 4.960 | 6.650 |
| 4.758 | 6.538 |
| 3.795 | 7.199 |
| 3.665 | 7.086 |
| 2.748 | 7.548 |
| 2.681 | 7.459 |
| 1.802 | 7.765 |
| 1.776 | 7.709 |
| 0.921 | 7.890 |
| 0.914 | 7.859 |
| 0.070 | 7.934 |
| 0.000 | 7.931 |

Figure 19A:
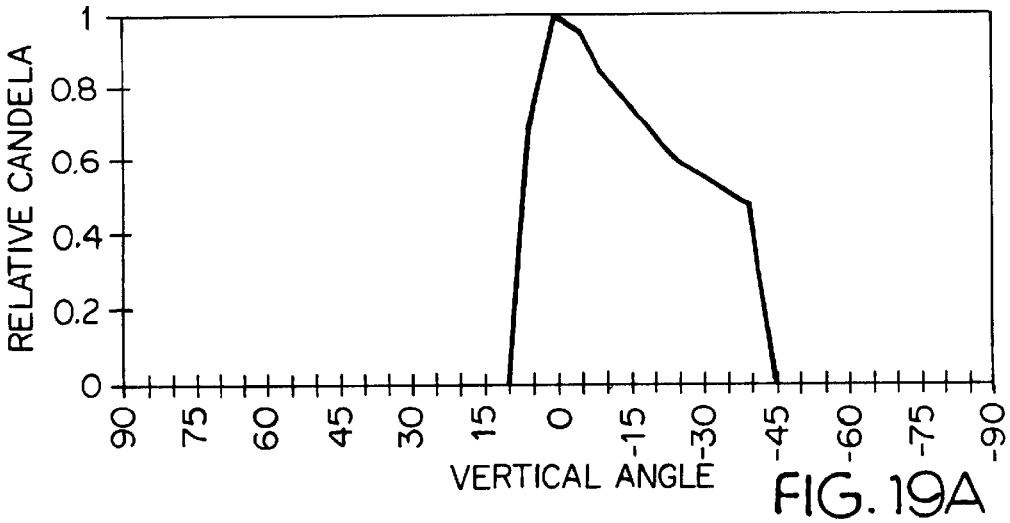
FIG. 19A is a diagram illustrating the ideal vertical candela trace of the principal reflectors of the invention.
Figure 19B:
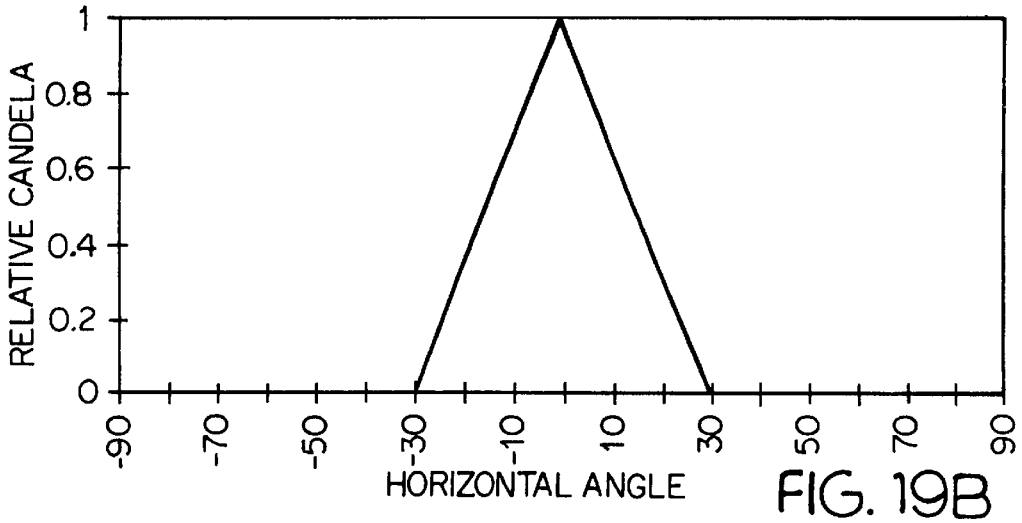
FIG. 19B is a diagram illustrating the ideal horizontal candela trace of the principal reflectors of the invention.

Referring now to FIG. 19A, a vertical candela trace is seen which is characteristic of the principal reflectors of the invention and particularly of the principal reflector 200 with the principal reflectors 22 and 190 approximating the vertical candela trace as seen in FIG. 19A. Use of the principal reflector 22 and 190 with shielding devices such as the flux manager 42 and further with the reflector insert 82 causes said principal reflectors 22 and 190 to more closely approximate the vertical candela trace seen in FIG. 19A. In the vertical candela trace of FIG. 19A, the bottom side of the beam is to the right, the candela distribution being arranged so that the maximum candela will occur at center bean. The vertical candela trace of FIG. 19A is essentially the same regardless of set back and mounting height assumptions and are essentially asymmetric with the majority of flux being directed below center beam. A very sharp, nearly linear cutoff occurs above center beam and an exponential behavior is exhibited between center beam and the lower extinction angle. A horizontal candela trace is seen in FIG. 19B and illustrates that the linear behavior required on either side of the illuminance pattern results in a linear and symmetric illuminance trace with respect to horizontal angle. Differing set back and mounting height assumptions essentially result in distributions with similar occurrence with the beam being linear and symmetric even though maximum value differs as does angular extent from left to right.

Figure 20:
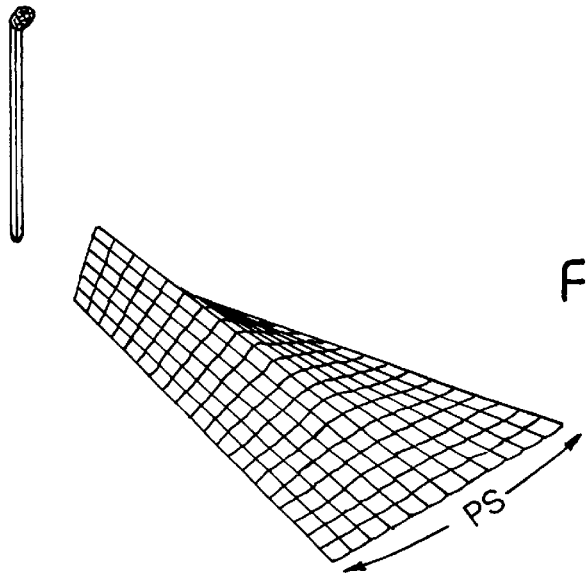
FIG. 20 is a schematic illustrating an ideal illuminance distribution such as is intended to be produced according to the invention.

The optics of the luminaire assemblies described herein are intended to produce a unique distribution of light characterized by a linear sloping to the front of the luminaire assembly and to the sides with each luminaire providing an illuminance distribution shaped as is seen in FIG. 20, a plurality of the luminaire assemblies of the invention in a cluster acting to produce essentially half of a flat cone with the distribution of FIG. 20 forming a section thereof which is perpendicular to the base of the cone which "halves" the cone with these distributions overlapping to some degree at edges thereof to produce the unique distribution of light provided by the present luminaire assemblies of the invention. It is to be understood relative to FIGS. 19A, 19B and 20 that these figures define ideal distributions for all of the primary reflector assemblies of the invention.

While the present flux management concept has been substantially described hereinabove in its application to luminaires intended for sportslighting, it is to be appreciated that the flux management concept can be applied to lighting fixtures of other description and particularly to outdoor lighting, spot lighting, wall-lighting and the like. The other kinds of lighting with which a flux management feature proves useful typically include the use of a reflector which is usually of a conventional nature. The use of a secondary reflector such as is described hereinabove relative to the sportslighting application can also be applied to other lighting fixtures of differing type. The intent of the flux management concept per se is to simultaneously shield and usefully redirect luminous flux which would otherwise exit a lighting fixture in an offending or inefficient manner. Greatest efficiency is accomplished through use of an involutely-shaped structure acting as the flux management feature. This involute is placed as close to the light source as is possible for redirection of beam as near the light source as possible. It is to be understood that a circular segment can be substituted for an involutely shaped flux manager with a savings of manufacturing cost.

Figure 21:
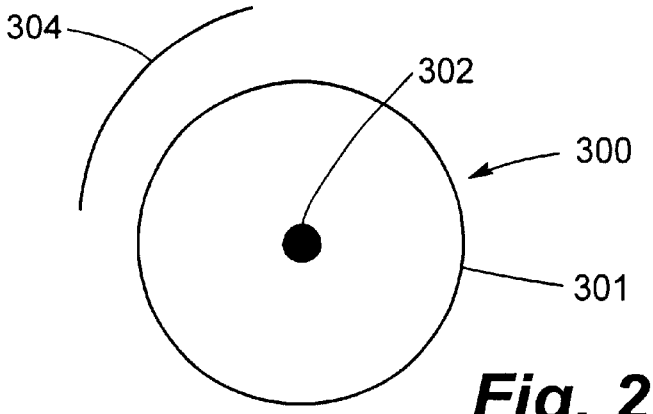
FIG. 21 is an idealized schematic illustrating placement of an involute flux manager relative to a lamp having an outer jacket.
Figure 22:
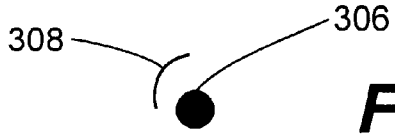
FIG. 22 is an idealized schematic of a flux manager comprised of an involute used with a lamp not provided with an outer jacket.
Figure 23:
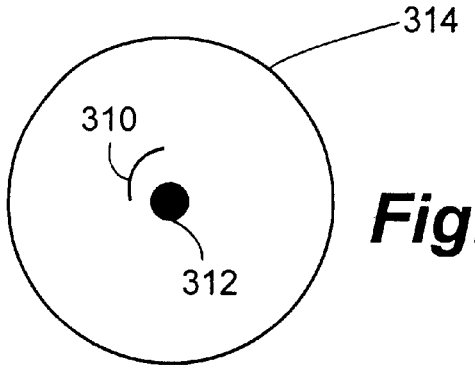
FIG. 23 is an idealized schematic of a flux management feature being provided in an environment having a lamp with an outer jacket, the flux manager being disposed within the envelope of the lamp.

Referring now to FIG. 21, a jacketed lamp 300 having a jacket 301 is seen to have a light source 302 disposed centrally therein, the light source being an arc, filament, etc. An involute 304 is positioned as close to the light source as is realistically possible in order to redirect a beam as closely to the light source 302 as possible. FIG. 22 illustrates a light source 306 which is not disposed within a jacket and which therefore has involute 308 more closely positioned thereto than is possible with the use of a jacketed lamp. The involute 308 can be supported by structure of the lighting fixture (not shown in FIG. 22) such as is shown relative to support of the flux manager 42 of FIG. 1 inter alia by structure of the luminaire assembly 10 as is described hereinabove, the flux manager 42 including an involute structure as described hereinabove. As an alternative, FIG. 23 illustrates the placement of an involute 310 in a position close to a light source 312 which is centrally disposed within a jacket 314. In other words, an involute such as the involute 310 could actually be disposed thin the interior of a jacketed lamp.

Figure 24:
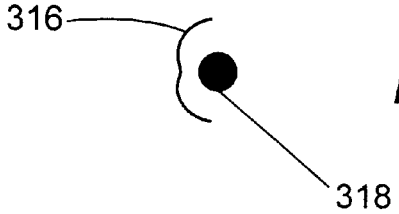
FIG. 24 is an idealized schematic of a "double" involute disposed relative to a lamp not having an outer jacket.

Any of the structures of FIGS. 21, 22 and 23 could be used with a "double involute" 316 as seen in FIG. 24 in a position disposed as near as possible to light source 318. In other words, the double involute 316 could be utilized externally of the jacketed lamp of FIG. 21 or internally of the jacketed lamp of FIG. 23. Essentially, FIG. 24 illustrates the double involute 316 within the same environment as occurs in FIG. 22.

Figure 25:
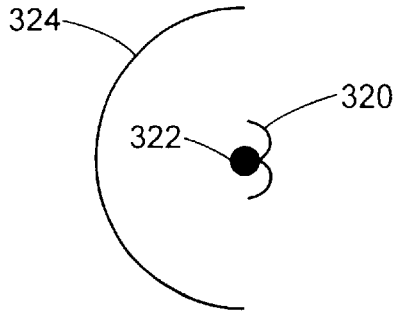
FIG. 25 is an idealized schematic illustrating a jacketless lamp in relation to a conventional reflector and having a "double involute" flux management feature which shields both upper and lower sides of a beam.

As shown in FIG. 25, a double involute 320 is disposed close to light source 322 in an environment wherein a reflector 324 of large size is employed. Effectively, both sides are shielded in the representation of FIG. 25, a situation which cannot occur with use of an outer jacket in a jacketed lamp since it is necessary for the double involute 320 to be placed extremely close to the light source 322. In such a situation, the reflector 324 must be sized in order to prevent light spillage.

Figure 26:
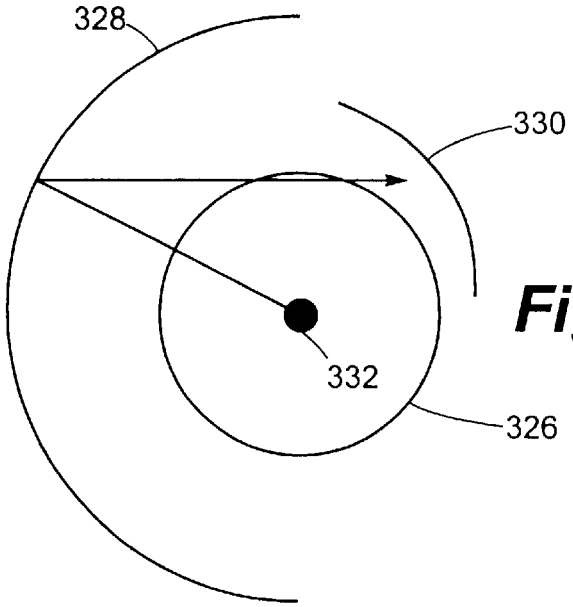
FIG. 26 is an idealized schematic illustrating an undesirable arrangement of the involute flux management feature whereby flux is impeded.
Figure 27:
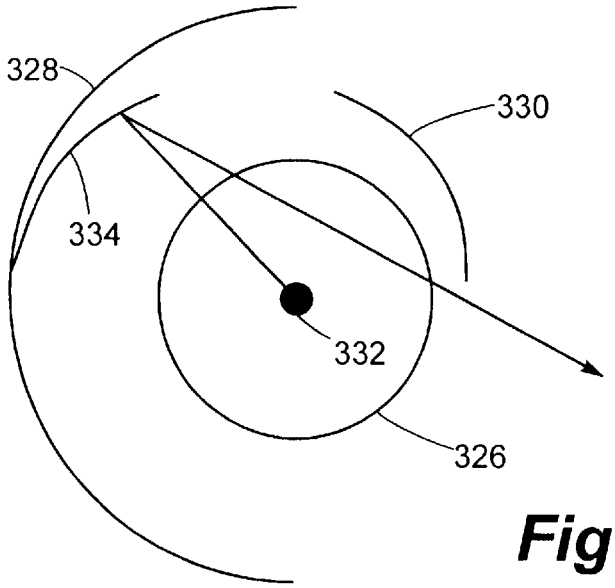
FIG. 27 is an idealized schematic illustrating use of a reflector insert in the apparatus of FIG. 26 so that flux is properly redirected.

When using a jacketed lamp 326 with a reflector 328 as seen in FIG. 26, it is not possible to place involute 330 in close relation to light source 332. Accordingly, as is illustrated in FIG. 26, flux is impeded which would otherwise come from the reflector 328 and the arrangement will not function well. FIG. 27 provides essentially the same structure as is provided in FIG. 26 with the addition of a reflective insert 334 such as is described hereinabove. The reflective insert 334 redirects that flux as is described herein relative to the sportslighting fixture of FIGS. 1 through 20. The reflective insert 334 can take the form of an additional component or can be formed as a part of the reflector 328 as long as the insert 334 is provided with the appropriate orientation as has been described hereinabove.

Figure 28:
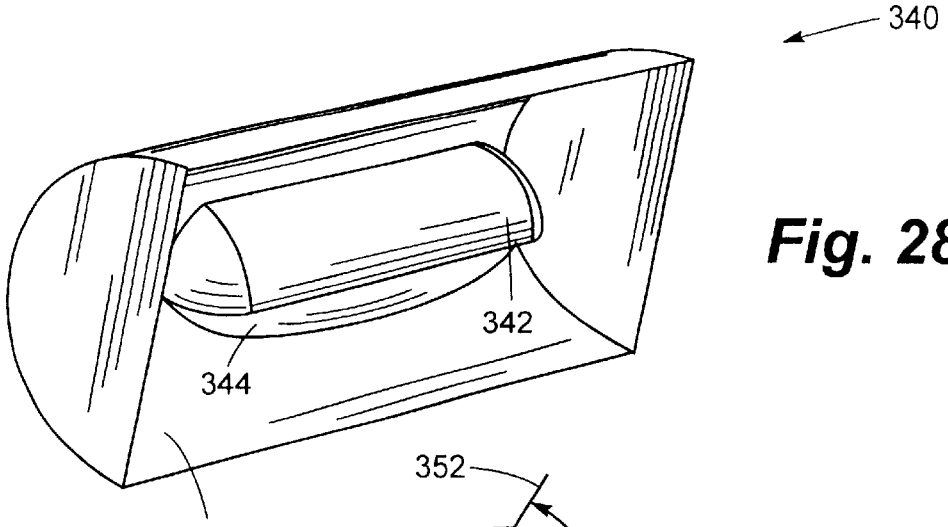
FIG. 28 is an idealized perspective of a flood light, as an example, including a main reflector of conventional design and a flux management device mounted relative to the flood lighting lamp to produce the advantages herein enumerated.

Referring now to FIG. 28, a luminaire which takes the form of a floodlight 340 is shown to be fitted with an involute 342 configured according to the invention. The involute 342 is mounted to a floodlight lamp 344 which is conventionally mounted within the body of the floodlight 340 which includes reflector 346. In FIG. 28, the flux manager 342 is essentially provided as an extruded shape as opposed to the axially symmetric shape such as is referred to hereinabove relative to certain of the sportslighting configurations. Definition of the involute 342 relative to shape including those equations used to shape the involute 342 have already been provided.

Figure 29:
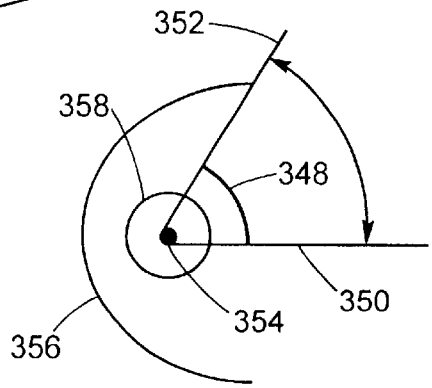
FIG. 29 is an idealized schematic illustrating the "shield zone" which an involute configured according to the invention can produce, the extent over which the involute is constructed in an angular sense depending upon the shield zone which is required as a matter of geometry and application.

Referring now to FIG. 29, the extent over which an involute 348 is to be constructed in an angular sense depends upon the shield zone defined by horizontal line 350 and line 352 drawn from light source 354 to an upper edge of reflector 356. Lamp 358 of FIG. 29 is a jacketed lamp. Placement of the line 352 is strictly a matter of geometry in application which is dependent upon the exigencies of a particular luminaire structure.

Figure 30:
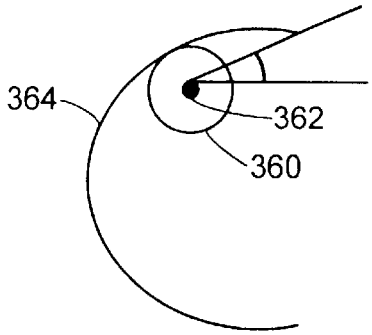
FIG. 30 is an idealized schematic illustrating the location of shield zone lines occurring due to a skewed arc placement, the shield zone lines always being tangent to the luminous source.

Referring now to FIG. 30, it is seen that a jacketed lamp 360 having light source 362 disposed centrally therein is mounted "off center", that is, not at the focal point of reflector 364. Even in the structure of FIG. 30, shield zone lines are formed tangent to the luminous source 362 and are so drawn in order to define the shield zone.

Figure 31:
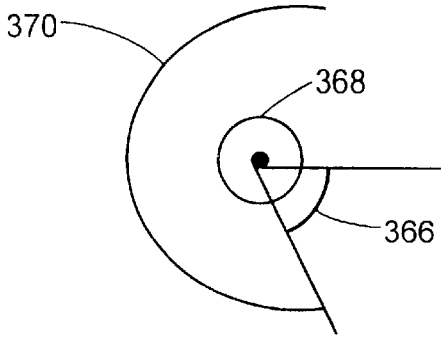
FIG. 31 is an idealized schematic illustrating placement of a flux management feature or shield relative to a lower portion of a lamp in order to redirect light upwardly from the fixture.

FIG. 31 illustrates shielding of a lower portion of a light beam by appropriate disposition of an involute 366 relative to a jacketed lamp 368 mounted within reflector 370.

Figure 32:
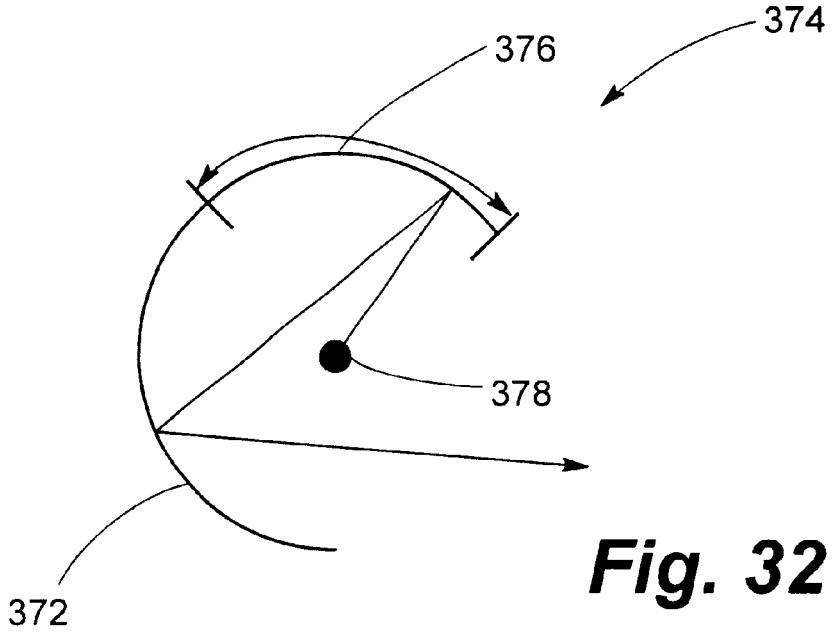
FIG. 32 is an idealized schematic of portions of a wall-mounted sconce lighting fixture wherein a reflector has an involute or flux managing section; and, FIG. 33 is an idealized schematic illustrating a particular involute section.

Referring now to FIG. 32, a reflector 372 of a wall-mounted fixture 374 is seen to have an involute section 376 integrally formed with the reflector 372. Luminous source 378 is located such that a single bounce off the involute 376 and from the reflector 372 is provided.

Figure 33:
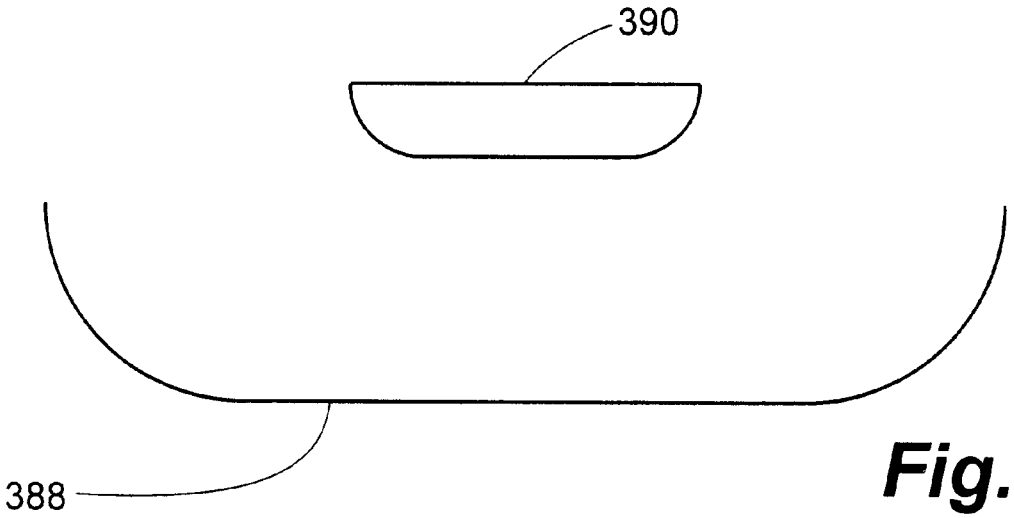

As has been previously noted, the involute or involute sections of the several forms of the invention can be formed as explicitly described hereinabove with the other dimension thereof being either a line, such as would form an extruded involute, a circle or a combination of the two. An ellipse may also be employed in order to generate the other dimension of the involute section. As an example of this generation, the involute particularly described relative to the sportslighting applications above utilize a combination of a line and two circular sections on the ends such as is noted in FIG. 33 relative to involute 388 which is positioned relative to arc 390 as described in detail hereinabove.

In optical terms, the difference in performance between the shaped involute described above and an offset circular section can be relatively small and often sufficiently small such that specification and tooling is made easier through use of a circular section which is offset slightly above a tangent line extending essentially centrally from the reflective portion of a given fixture.

While the invention has been described in light of explicit embodiments thereof, it is to be understood that the invention can be embodied other than as explicitly described and shown herein, the scope of the invention being defined by the recitations of the appended claims.

What is claimed is:

1. In a lighting fixture having a reflector assembly and a light source, at least a portion of the light produced by the light source exiting the fixture as light spillage or glare, the improvement comprising:

shielding means mounted by the fixture for blocking light from the light source which otherwise would produce glare and for redirecting that light past lamp arc and against reflective surfaces of the reflector assembly and back into a beam directed onto an area which is to be illuminated.

2. In the fixture of claim 1 wherein the shielding means is involutely shaped.

3. In the fixture of claim 1 wherein the shielding means is shaped with a section similar to or identical to a circular arc.

4. In the fixture of claim 1 wherein the shielding means is shaped as an involute curve capped by revolving the curve to form a surface of revolution.

5. In the fixture of claim 1 wherein the shielding means is disposed above a horizontal centerline of an optical chamber at least partially defined by the reflector assembly.

6. In the fixture of claim 1 wherein the improvement further comprises secondary reflector means disposed within the fixture and between the shielding means and reflective inner wall surfaces of the reflector assembly for redirecting flux which would impinge the shielding means to cause the maximum possible flux to exit the reflector assembly at the highest possible angle below center beam without striking the shielding means and without being incident on lamp arc.

7. In the fixture of claim 6 wherein the secondary reflector means comprises a plurality of reflective facets, each of the facets being aimed to redirect flux incident thereon.

8. In the fixture of claim 1 wherein the improvement further comprises secondary reflector means disposed within the fixture and between the shielding means and the reflective inner wall surfaces of the reflector assembly for re-aiming flux blocked by the shielding means to cause the blocked flux to exit the reflector assembly without striking the shielding means and without being incident on lamp arc.

9. In the fixture of claim 8 wherein the secondary reflector means comprise a plurality of reflective facets, each of the facets being aimed to redirect flux incident thereon.

10. A luminaire for illuminating an area, comprising:

a reflector having reflective inner walls and at least partially defining an optical chamber;

a lamp mounted within the optical chamber to produce light; and, shielding means mounted within the optical chamber for blocking light from the lamp which would exit the reflector assembly as spill light and redirecting the spill light past lamp arc and back into a beam directed onto said area.

11. A luminaire for illuminating an area, comprising:

a reflector having reflective inner walls and at least partially defining an optical chamber;

a lamp mounted within the optical chamber to produce light; and, shielding means mounted by the luminaire and spaced from the lamp for blocking light from the lamp which would exit the luminaire as spill light and redirecting the spill light past lamp arc and back into a beam directed onto said area.

12. The luminaire of claim 11 wherein the shielding means is shaped with a section similar to or identical to a circular arc.

13. The luminaire of claim 12 wherein the shielding means is disposed above a horizontal centerline of the optical chamber.

14. The luminaire of claim 11 wherein the shielding means is involutely shaped.

15. The luminaire of claim 11 wherein the shielding means is shaped as an involute curve capped by revolving the curve to form a surface of revolution.

16. The luminaire of claim 11 wherein the shielding means is disposed above a horizontal centerline of the optical chamber.

17. The luminaire of claim 11 i and further comprising secondary reflector means disposed within the optical chamber and between the shielding means and reflective inner wall surfaces of the reflector for redirecting flux which would impinge the shielding means to cause the maximum possible flux to exit the reflector assembly at the highest possible angle below center beam without striking the shielding means and without being incident on lamp arc.

18. The luminaire of claim 17 wherein the secondary reflector means comprises a plurality of reflective facets, each one of the facets being aimed to redirect flux incident thereon.

19. The luminaire of claim 11 and further comprising secondary reflector means disposed within the optical chamber and between the shielding means and the reflective inner wall surfaces of the reflector for re-aiming flux blocked by the shielding means to cause the blocked flux to exit the reflector assembly without striking the shielding means and without being incident on lamp arc.

20. The luminaire of claim 19 wherein the secondary reflector means comprise a plurality of reflective facets, each of the facets being aimed to redirect flux incident thereon.

21. The luminaire of claim 11 wherein the shielding means is shaped as a double involute.

22. The luminaire of claim 11 wherein the shielding means is shaped as a double circular arc.

23. The luminaire of claim 11 wherein the lamp has a jacket and the shielding means is disposed internally of the jacket.

24. The luminaire of claim 11 wherein the shielding means is integrally formed with the reflector.

* * * * *